US007367660B2

(12) United States Patent
Koga et al.

(10) Patent No.: US 7,367,660 B2
(45) Date of Patent: May 6, 2008

(54) INK-JET RECORDING APPARATUS

(75) Inventors: Yuji Koga, Nagoya (JP); Takatoshi Takemoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 299 days.

(21) Appl. No.: 11/275,844

(22) Filed: Jan. 31, 2006

(65) Prior Publication Data

US 2006/0170739 A1 Aug. 3, 2006

(30) Foreign Application Priority Data

Jan. 31, 2005 (JP) ..... 2005-024424

(51) Int. Cl.
*B41J 2/175* (2006.01)

(52) U.S. Cl. ..... 347/85

(58) Field of Classification Search ..... 347/5, 347/7, 30, 35, 84, 85; 141/2, 7, 18
See application file for complete search history.

(56) References Cited

U.S. PATENT DOCUMENTS 6,048,055 A * 4/2000 Hakkaku ..... 347/86
6,058,984 A * 5/2000 Sato ..... 141/7
6,540,321 B1 * 4/2003 Hirano et al. ..... 347/22
6,612,689 B2 9/2003 Suenaga et al.
6,905,197 B2 6/2005 Suenaga et al.
7,097,288 B2 * 8/2006 Van Os et al. ..... 347/85
7,104,630 B2 * 9/2006 Steinmetz et al. ..... 347/49

FOREIGN PATENT DOCUMENTS

JP 2002120380 A 4/2002
JP 2002200774 A 7/2002

* cited by examiner

*Primary Examiner*—Anh T. N. Vo
(74) *Attorney, Agent, or Firm*—Baker Botts L.L.P

(57) ABSTRACT

An ink-jet recording apparatus is provided which can be composed of fewer number of parts and easily controlled. In the ink-jet recording apparatus, one pressurized unit such as a pressurized pump for ink supply is used. An open/close state switching member which opens/closes an air communication hole of a sub-tank is integrally formed with an ink supply member which supplies ink within a main tank to the sub-tank. Accordingly, depending on a relative position between the ink supply member and the sub-tank, the operation mode is easily switched to at least following three modes: recording mode, ink supply mode (standby mode), and discharge performance recovery mode.

8 Claims, 18 Drawing Sheets

| | AIR COMMUNICATION HOLE | INK SUPPLY HOLE | |
|---|---|---|---|
| A | OPEN | NOT CONNECTED | DURING PRINTING |
| B | OPEN | CONNECTED | DURING INK SUPPLY, DURING STANDBY |
| C | CLOSED | CONNECTED | DURING POSITIVE PRESSURE PURGE |

FIG. 5A
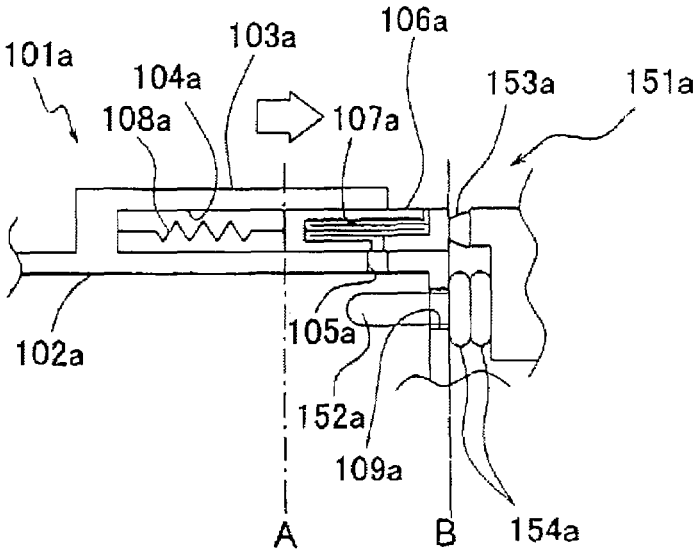
FIG. 5B
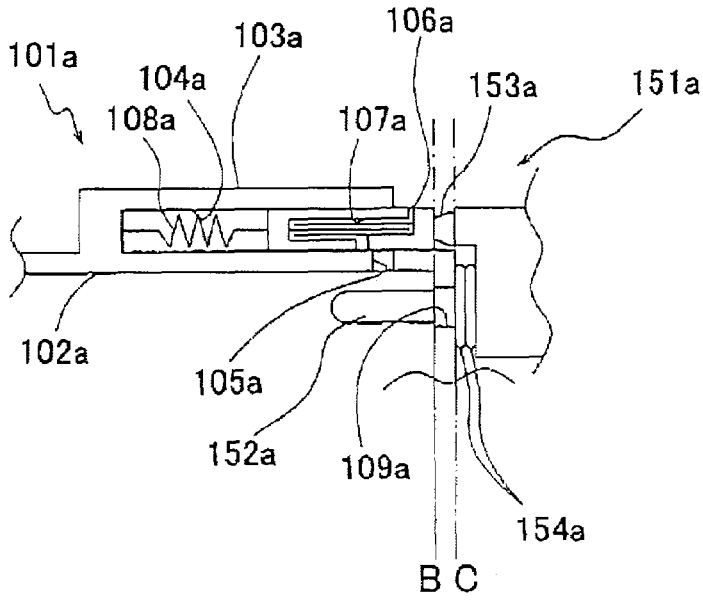
FIG. 5C
| | AIR COMMUNICATION HOLE | INK SUPPLY HOLE | |
|---|---|---|---|
| A | OPEN | NOT CONNECTED | DURING PRINTING |
| B | OPEN | CONNECTED | DURING INK SUPPLY, DURING STANDBY |
| C | CLOSED | CONNECTED | DURING POSITIVE PRESSURE PURGE |

FIG.7A
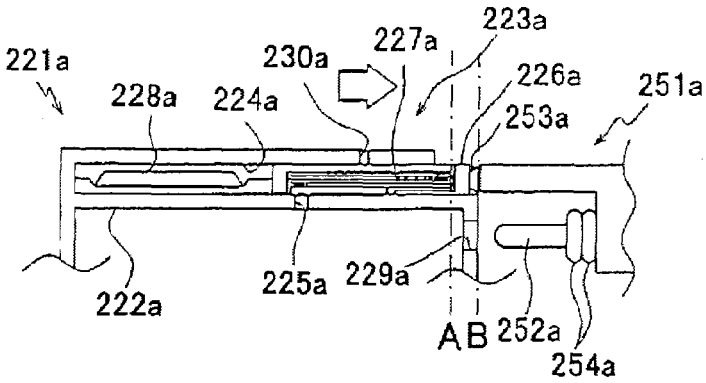
FIG.7B
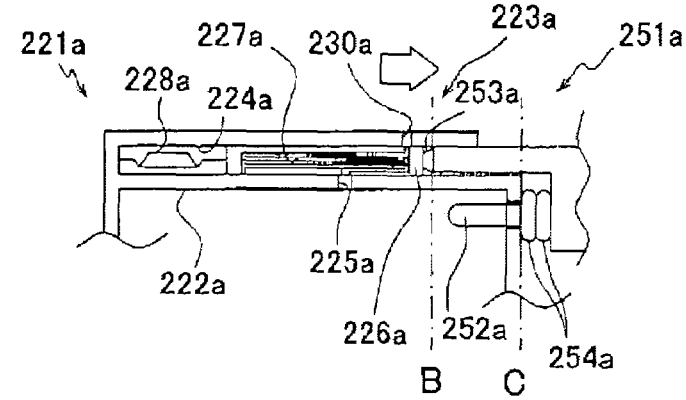
FIG.7C
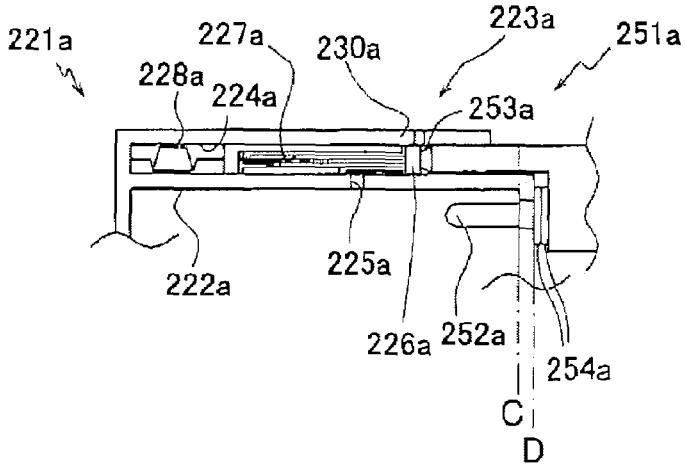
FIG.7D
| | AIR COMMUNICATION HOLE | INK SUPPLY HOLE | |
|---|---|---|---|
| A | OPEN | NOT CONNECTED | DURING PRINTING |
| B | CLOSED | NOT CONNECTED | DURING LONG-TERM STORAGE |
| C | OPEN | CONNECTED | DURING INK SUPPLY, DURING STANDBY |
| D | CLOSED | CONNECTED | DURING POSITIVE PRESSURE PURGE |

FIG.9A
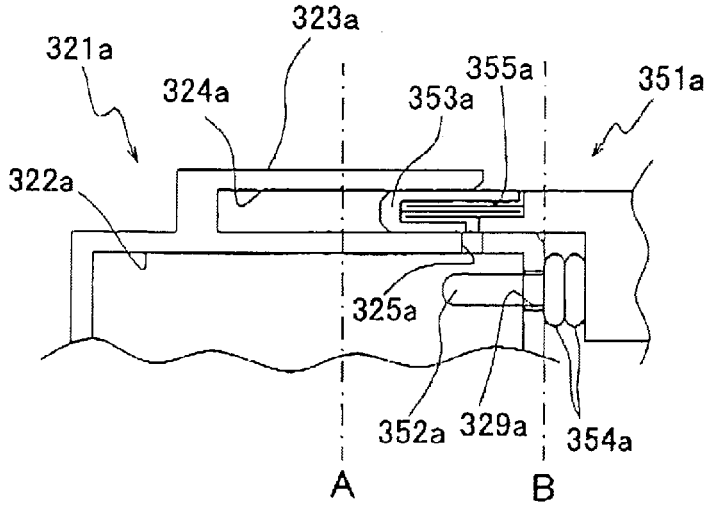
FIG.9B
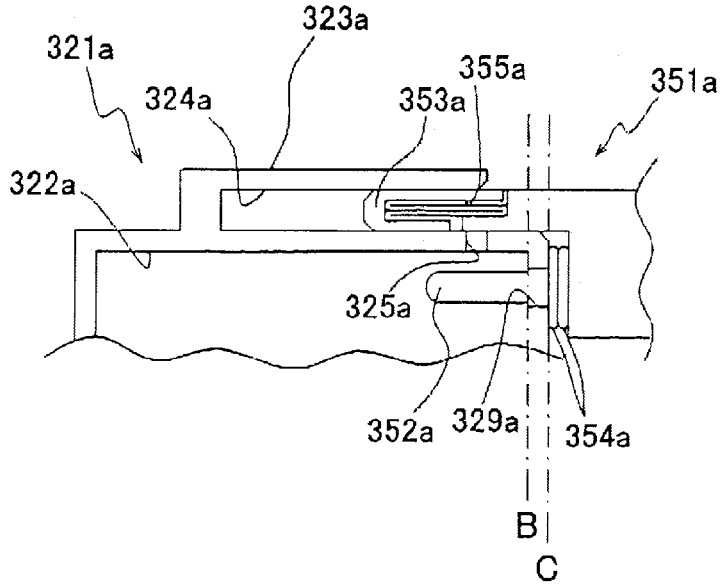
FIG.9C
| | AIR COMMUNICATION HOLE | INK SUPPLY HOLE | |
|---|---|---|---|
| A | OPEN | NOT CONNECTED | DURING PRINTING |
| B | OPEN | CONNECTED | DURING INK SUPPLY, DURING STANDBY |
| C | CLOSED | CONNECTED | DURING POSITIVE PRESSURE PURGE |

FIG.11A
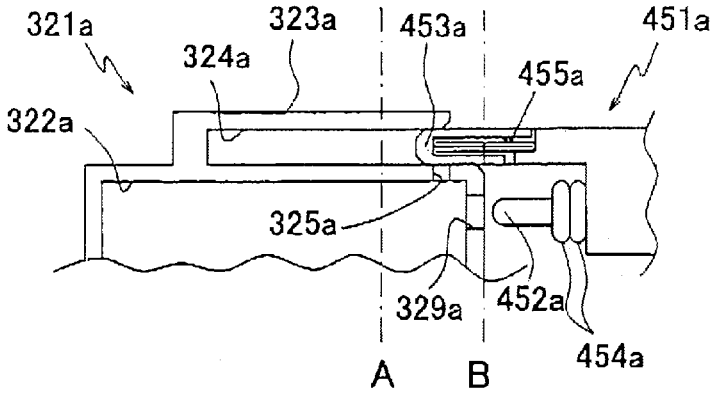
FIG.11B
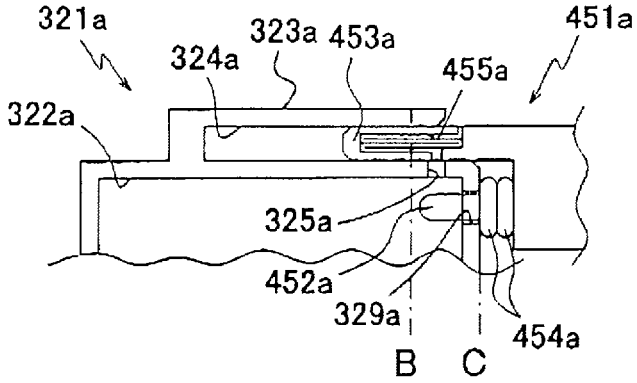
FIG.11C
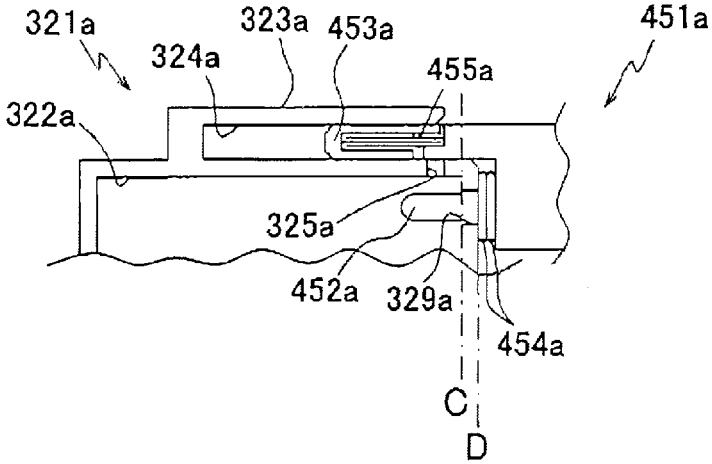
FIG.11D
| | AIR COMMUNICATION HOLE | INK SUPPLY HOLE | |
|---|---|---|---|
| A | OPEN | NOT CONNECTED | DURING PRINTING |
| B | CLOSED | NOT CONNECTED | DURING LONG-TERM STORAGE |
| C | OPEN | CONNECTED | DURING INK SUPPLY, DURING STANDBY |
| D | CLOSED | CONNECTED | DURING POSITIVE PRESSURE PURGE |

FIG.13A
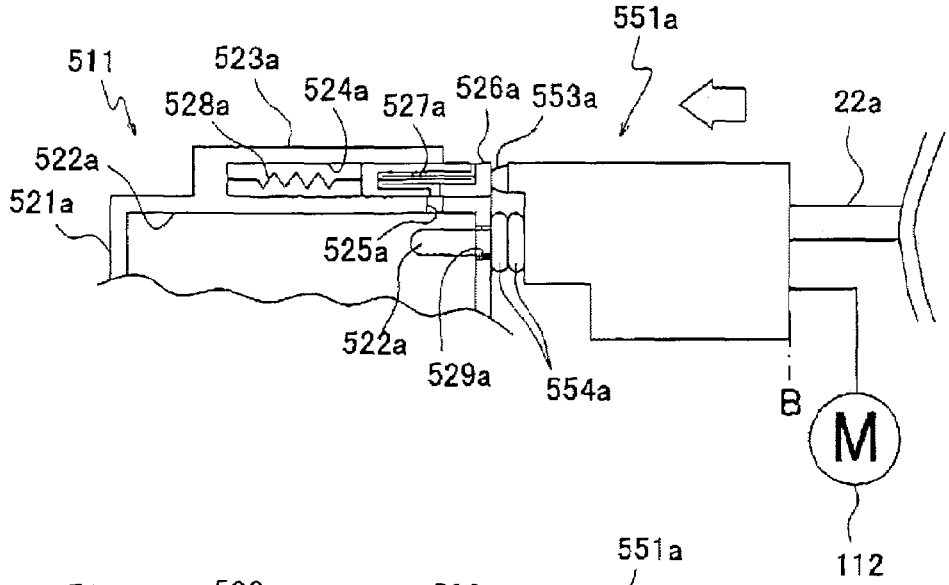
FIG.13B
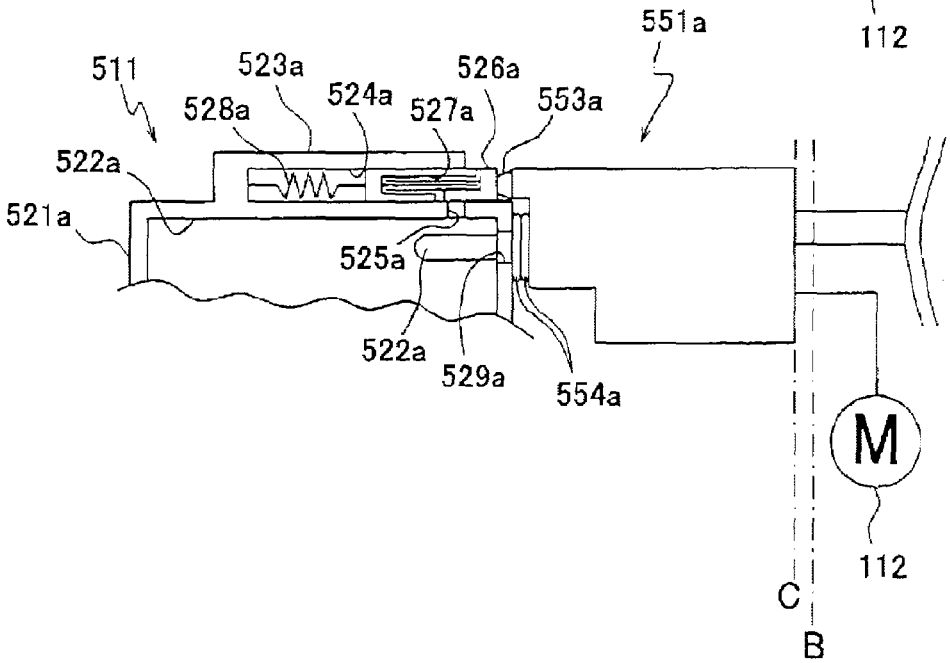
FIG.13C
| | AIR COMMUNICATION HOLE | INK SUPPLY HOLE | |
|---|---|---|---|
| A | OPEN | NOT CONNECTED | DURING PRINTING |
| B | OPEN | CONNECTED | DURING INK SUPPLY, DURING STANDBY |
| C | CLOSED | CONNECTED | DURING POSITIVE PRESSURE PURGE |

FIG.15A
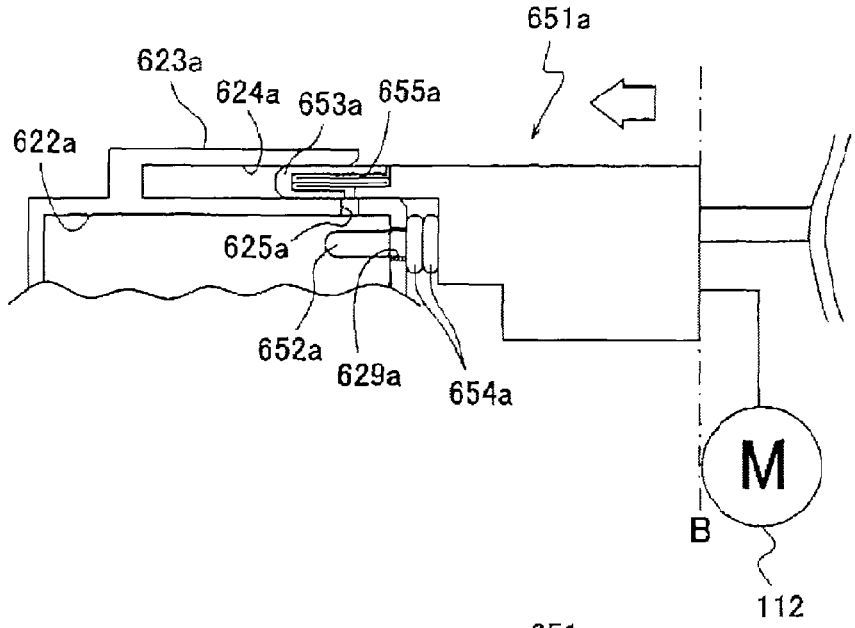
FIG.15B
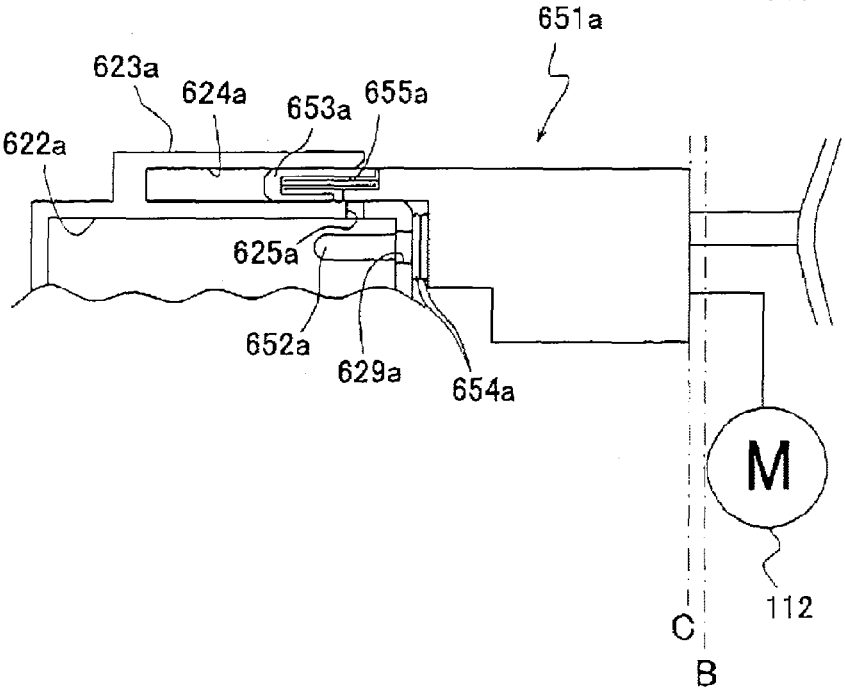
FIG.15C
| | AIR COMMUNICATION HOLE | INK SUPPLY HOLE | |
|---|---|---|---|
| A | OPEN | NOT CONNECTED | DURING PRINTING |
| B | OPEN | CONNECTED | DURING INK SUPPLY, DURING STANDBY |
| C | CLOSED | CONNECTED | DURING POSITIVE PRESSURE PURGE |

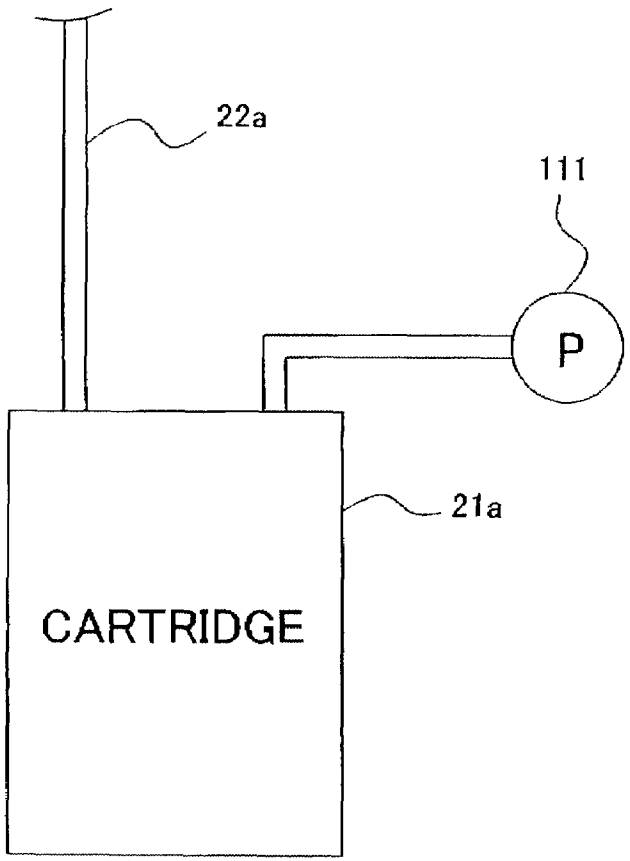
FIG.16
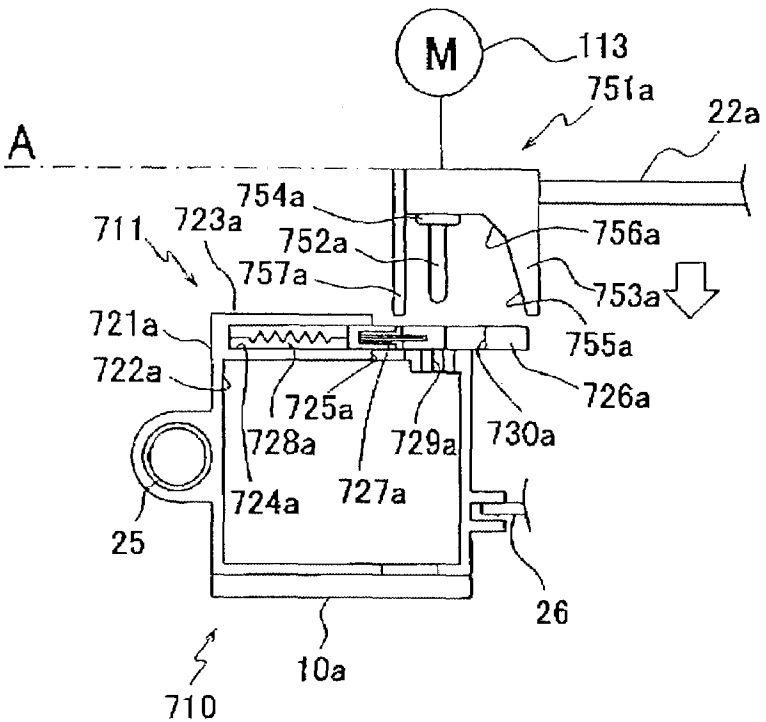

| | AIR COMMUNICATION HOLE | INK SUPPLY HOLE | |
|---|---|---|---|
| A | OPEN | NOT CONNECTED (CLOSED) | DURING PRINTING |
| B | CLOSED | NOT CONNECTED (CLOSED) | DURING LONG-TERM STORAGE |
| C | OPEN | CONNECTED (OPEN) | DURING INK SUPPLY, DURING STANDBY |
| D | CLOSED | CONNECTED (OPEN) | DURING POSITIVE PRESSURE PURGE |

INK-JET RECORDING APPARATUS

CROSS-REFERENCE TO RELATED APPLICATIONS

This application claims the benefit of Japanese Patent Application No. 2005-24424 filed Jan. 31, 2005 in the Japan Patent Office, the disclosure of which is incorporated herein by reference.

BACKGROUND

This invention relates to a technique for providing an ink-jet recording apparatus that can be composed of fewer number of parts and easily controlled.

Heretofore, an ink-jet recording apparatus is known to include a stationary ink supply system. That is, this type of ink-jet recording apparatus is provided with a carriage with a recording head and an ink tank mounted thereon, and a main tank storing ink supplied to the ink tank. The recording head ejects ink from an injection nozzle to perform recording onto a recording media, and the ink tank stores ink supplied to the recording head. When the ink in the ink tank is decreased, ink in the main tank is supplied to a sub-tank (ink tank).

Among the aforementioned ink-jet recording apparatus, there is one which is designed to supply ink from the main tank by reducing pressure inside the ink tank mounted on the carriage. Particularly, such an ink-jet recording apparatus includes a recording head carriage (hereinafter, referred to as a carriage) with a recording head and a sub-ink tank for storing ink supplied to the recording head mounted thereon, a main tank for storing ink supplied to the ink tank, and an ink refiller. Among the aforementioned components, the sub-ink tank mounted on the carriage includes a refill port for receiving an ink refill from the main tank, an exhaust port for discharging air inside the sub-ink tank, and an air communication hole for communicating the inside of the sub-ink tank with the atmosphere. On the other hand, the ink refiller includes a refill port for supplying ink stored in the main tank to the sub-ink tank when connected to the refill port of the sub-ink tank, an exhaust port for connecting to the exhaust port of the sub-ink tank, a pump unit that reduces pressure inside the sub-ink tank through the exhaust port, and a cap that seals the air communication hole of the sub-ink tank when the cap abuts the air communication hole. The ink refiller is designed capable of changing its relative position to the carriage by a moving mechanism. When ink is supplied from the main tank to the sub-ink tank, the ink refiller is moved toward the carriage by the moving mechanism so that the refill port of the sub-ink tank is connected to the refill port of the ink refiller and the exhaust port of the sub-ink tank is connected to the exhaust port of the ink refiller. Also, the air communication hole of the sub-ink tank is sealed by the cap of the ink refiller. When the pump unit of the ink refiller reduces pressure inside the sub-ink tank through the exhaust ports of the ink refiller and of the sub-ink tank, since the air communication hole of the sub-ink tank is sealed by the cap of the ink refiller, the ink stored in the sub-ink tank is supplied into the sub-ink tank through the refill ports of the ink refiller and of the sub-ink tank.

SUMMARY

However, in the aforementioned ink-jet recording apparatus, ink is supplied from the main tank by reducing pressure inside the ink tank mounted on the carriage by the pump unit. Thus, the pump unit is disposed on a downstream side in the ink supply passage. In this case, for example, an exhaust port of the sub-ink tank and an exhaust port of the ink refiller are necessary. There are problems in which the number of parts is increased and the control of the aforementioned respective components becomes complex.

The present invention is made to solve the above problems. It would be desirable to provide an ink-jet recording apparatus that can be composed of fewer number of parts and easily controlled.

One aspect of the present invention provides an ink-jet recording apparatus including: a recording head, a carriage, a main tank, an ink supply member, and a relative position changer. The recording head has an internal sub-tank for storing ink, and records an image on a recording medium by selectively ejecting ink inside the sub-tank from an injection nozzle. The carriage has the recording head mounted thereon, and can move to and fro in a direction orthogonal to a conveying direction of the recording medium. The main tank stores ink supplied to the sub-tank. The ink supply member supplies ink inside the main tank to the sub-tank. The relative position changer can change a relative position between the ink supply member and the sub-tank. The sub-tank includes an ink supply opening which can be attached to/detached from the ink supply member and through which the ink inside of the main tank is supplied, and an air communication hole that communicates the inside of the sub-tank with the atmosphere. The ink supply member includes an ink supply nozzle that can be attached to/detached from the ink supply opening, and an open/close state switching member that switches an open/close state of the air communication hole. The ink-jet recording apparatus further includes a pressurized unit that applies pressure to the ink inside the main tank so as to deliver the ink inside the main tank to the ink supply member, and a relative position controller that controls the relative position changer to switch an operation mode of the ink-jet recording apparatus to at least following three modes: (a) a recording mode in which the ink supply opening and the ink supply nozzle are separated and the air communication hole is in an open state so that recording of an image on the recording medium is enabled; (b) an ink supply mode in which the ink supply opening is connected to the ink supply nozzle and the air communication hole is in an open state so that ink is supplied to the sub-tank by pressure applied by the pressurized unit; and (c) a discharge performance recovery mode in which the ink supply opening and the ink supply nozzle are closely connected and the air communication hole is in a closed state so that discharge performance of the recording head is recovered by the pressure applied by the pressurized unit.

BRIEF DESCRIPTION OF THE DRAWINGS

The invention will now be described below, by way of example, with reference to the accompanying drawings, in which:

FIG. 5A is an explanatory view showing the recording head and the ink supply mechanism according to the first embodiment during ink supply and during standby;

FIG. 5B is an explanatory view showing the recording head and the ink supply mechanism according to the first embodiment during positive pressure purge;

FIG. 5C is a table showing an open/close state of an air communication hole and an ink supply opening according to the first embodiment;

FIG. 7A is an explanatory view showing the recording head and the ink supply mechanism according to the second embodiment during long-term storage;

FIG. 7B is an explanatory view showing the recording head and the ink supply mechanism according to the second embodiment during ink supply and during standby;

FIG. 7C is an explanatory view showing the recording head and the ink supply mechanism according to the second embodiment during positive pressure purge;

FIG. 7D is a table showing an open/close state of the air communication hole and the ink supply opening according to the second embodiment;

FIG. 9A is an explanatory view showing the recording head and the ink supply mechanism according to the third embodiment during ink supply and during standby;

FIG. 9B is an explanatory view showing the recording head and the ink supply mechanism according to the third embodiment during positive pressure purge;

FIG. 9C is a table showing an open/close state of the air communication hole and the ink supply opening according to the third embodiment;

FIG. 11A is an explanatory view showing the recording head and the ink supply mechanism according to the fourth embodiment during long-term storage;

FIG. 11B is an explanatory view showing the recording head and the ink supply mechanism according to the fourth embodiment during ink supply and during standby;

FIG. 11C is an explanatory view showing the recording head and the ink supply mechanism according to the fourth embodiment during positive pressure purge;

FIG. 11D is a table showing an open/close state of the air communication hole and the ink supply opening according to the fourth embodiment;

FIG. 13A is an explanatory view showing the recording head and the ink supply mechanism according to the fifth embodiment during ink supply and during standby;

FIG. 13B is an explanatory view showing the recording head and the ink supply mechanism according to the fifth embodiment during positive pressure purge;

FIG. 13C is a table showing an open/close state of the air communication hole and the ink supply opening according to the fifth embodiment;

FIG. 15A is an explanatory view showing the recording head and the ink supply mechanism according to the sixth embodiment during ink supply and during standby;

FIG. 15B is an explanatory view showing the recording head and the ink supply mechanism according to the sixth embodiment during positive pressure purge;

FIG. 15C is a table showing an open/close state of the air communication hole and the ink supply opening according to the sixth embodiment;

FIG. 16 is an explanatory view showing a schematic structure of a recording head and an ink supply mechanism according to a seventh embodiment;

DETAILED DESCRIPTION OF THE PREFERRED EMBODIMENT

First Embodiment

In the present embodiment, the invention is applied to a multifunctional apparatus provided with a printer function, a copying function, a scanner function, a facsimile function, and a phone function.

[Description of Multifunctional Apparatus 1]

Figure 1:
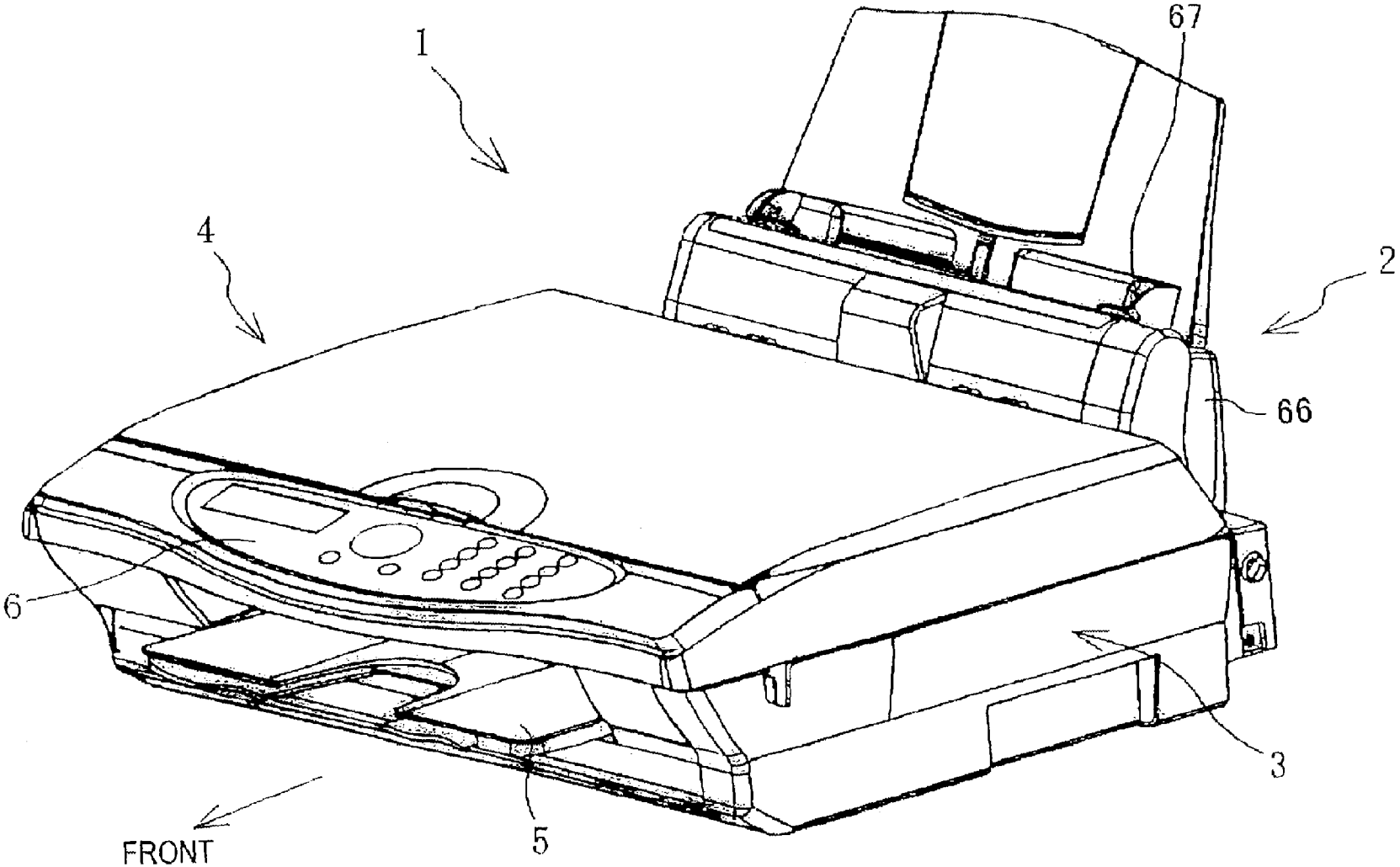
FIG. 1 is a perspective view of a multifunctional apparatus including a printing function, a copying function, a scanner function, a facsimile function, and a telephone function.

Referring to FIG. 1, a multifunctional apparatus 1 is provided with a feeding device 2 at a rear end portion. On the front side below the feeding device 2, an ink-jet printer 3 is provided. On top of the printer 3, a reader 4 for the copying function and facsimile function is provided. A discharge tray 5 is provided on the front side of the printer 3. An operation panel 6 is provided on the upper face at the front end of the reader 4.

The feeding device 2 includes a slant wall 66 that retains a sheet at a slanted attitude, and an expanded sheet guide board 67 that is detachably attached to the slant wall 66. A plurality of sheets can be loaded on the feeding device 2. The slant wall 66 internally includes a feed motor 65 (see FIG. 3) and a feed roller (not shown). The feed roller rotates by the driving force of the feed motor 65 and delivers a sheet toward the printer 3.

[Description of Printer 3]

Figure 2:
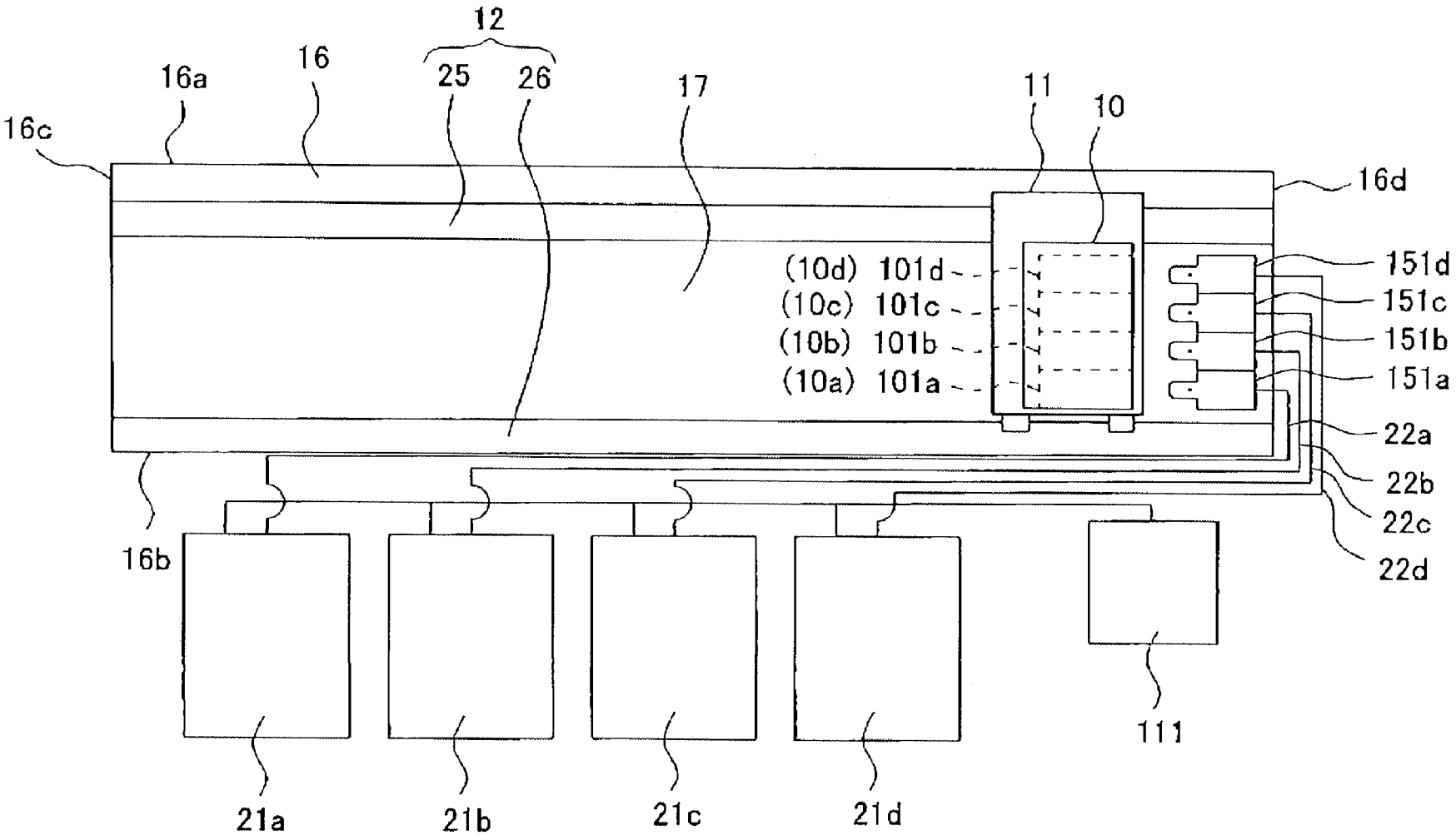
FIG. 2 is an explanatory view showing a schematic internal structure of a printer provided in the multifunctional apparatus.

Now, the structure of the printer 3 is described by way of FIG. 2. FIG. 2 is a schematic diagram of the internal structure of the printer 3.

As shown in FIG. 2, the printer 3 includes a recording head 10, a carriage 11, a guide mechanism 12, a carriage moving mechanism (not shown), a sheet delivery mechanism (not shown), and a maintenance mechanism (not shown) for the recording head 10. The guide mechanism 12 holds the carriage 11 with the recording head 10 mounted thereon in such a manner that the carriage 11 can move in a horizontal direction or a main scanning direction. The carriage moving mechanism moves the carriage 11 in the horizontal direction. The sheet delivery mechanism delivers a sheet fed from the feeding device 2

The printer 3 is also provided with a frame 16 of a rectangular parallelepiped. The frame 16 is long in the horizontal direction and short in the vertical direction. The guide mechanism 12, the carriage moving mechanism, the sheet delivery mechanism, and the maintenance mechanism are all attached to the frame 16. Moreover, the recording head 10 and the carriage 11 are accommodated inside the frame 16 in a manner capable of moving in the horizontal direction.

Inlet and outlet (not shown) for the sheet are respectively formed on the rear and front side boards 16*a*, 16*b* of the frame 16. The sheet supplied by the feeding device 2 is guided into the frame 16 from the inlet. The sheet is then delivered forward by the sheet delivery mechanism and discharged from the outlet to the discharge tray 5 (see FIG. 1) located further ahead. Also, a black platen 17, having a plurality of ribs, is attached to the bottom portion of the frame 16. Inside the frame 16, recording (image forming) by the recording head 10 is performed on the sheet being moved across the platen 17.

Four color ink cartridges 21*a* to 21*d* are attached to a cartridge attachment portion (not shown) on the front side of the frame 16. The cartridges 21*a* to 21*d* are respectively connected to ink supply mechanisms 151*a* to 151*d*, disposed in the vicinity of the right end of the frame 16, via four flexible ink tubes 22*a* to 22*d* that pass through the inside of the frame 16.

Two horizontally-arranged FPCs (flexible print circuits, not shown) are installed inside the frame 16. The FPCs extend to and are connected to the recording head 10. The two horizontally-arranged FPCs include wiring of a plurality of signal lines that electrically connect a later-explained control processor 70 (see FIG. 3) and the recording head 10.

The guide mechanism 12 has a guide shaft 25 and a guide rail 26. The guide shaft 25 is laid along the horizontal direction at the rear portion inside the frame 16. Both ends of the guide shaft 25 are respectively connected to a left side board 16*c* and a right side board 16*d* of the frame 16. The guide rail 26 is formed at the front portion inside the frame 16 and extends along the horizontal direction. The rear end portion of the carriage 11 slidably fits onto the guide shaft 25, while the front end portion of the carriage 11 slidably engages with the guide rail 26.

The carriage moving mechanism is provided with a carriage motor 30 (see FIG. 3) and a belt mechanism (not shown). The belt mechanism transmits the driving force of the carriage motor 30 to the carriage 11. The carriage moving mechanism is driven and controlled by the later-explained control processor 70 (see FIG. 3). That is, the carriage 11 is driven via the belt mechanism by the driven carriage motor 30.

The sheet delivery mechanism is provided with a sheet delivery motor 40 (see FIG. 3), a resist roller (not shown), a discharge roller (not shown), and a belt mechanism (not shown) for transmitting the driving force of the sheet delivery motor 40 to the resist roller and the discharge roller. The sheet delivery mechanism is driven and controlled by the later-explained control processor 70 (see FIG. 3). Particularly, the sheet delivery mechanism includes a sheet delivery encoder 50. Based on the detection signal from the sheet delivery encoder 50 (more particularly, a photo interrupter), the later-explained control processor 70 drives and controls the sheet delivery motor 40. The resist roller is rotated via the belt mechanism by the driven sheet delivery motor 40 so that the sheet is delivered to and fro or discharged to the discharge tray 5 located ahead.

The maintenance mechanism includes a wiper (not shown), two caps (not shown), and a drive motor (not shown). The wiper wipes off the head face of the recording head 10. Each of the two caps can seal two out of four ink nozzle groups 10*a* to 10*d*. The drive motor drives both the wiper and the caps. The wiper, the caps, and the drive motor are attached to an attachment board (not shown) fixed on the undersurface at the right portion of the bottom board of the frame 16.

A media sensor 68 (see FIG. 3) is disposed at the left end portion of the recording head 10 as viewed in FIG. 2. The media sensor 68 is provided as a downstream sensor that can detect a front edge, a rear edge, and side edges in a width direction of a sheet. The media sensor 68 is a reflective type optical sensor including a light-emitter (light-emitting element) and a light-receiver (light-receiving element). The media sensor 68 is attached downward to a sensor attachment portion which protrudes leftward of the recording head 10.

On the upstream side (i.e., rear side) in the sheet delivery direction of the media sensor 68, a resist sensor 69 (see FIG. 3) is provided as an upstream sensor that can detect the presence/absence of the sheet, or the front edge and rear edge of the sheet. Particularly, the resist sensor 69 is attached to the front end portion of an upper cover that forms a delivery path for the feeding device 2.

The resist sensor 69 can be constituted, for example, from a detector, a photo interrupter, and a mechanical sensor. The detector protrudes into the sheet delivery path and is rotated when the sheet being delivered abuts the detector. The photo interrupter includes a light-emitter and a light-receiver, and detects rotation of the detector. The mechanical sensor has a torsion spring that biases the detector to the side of the sheet delivery path. Shielding is provided integrally with the detector. When the detector is rotated by the sheet being delivered, the shielding is disposed in a region other than between the light-emitter and the light-receiver of the photo interrupter. Then, the light transmission from the light-emitter to the light-receiver is performed, and the resist sensor 69 turns to an ON state. When the sheet is not delivered, the detector is biased to the side of the sheet delivery path by the torsion spring. The shielding is disposed between the light-emitter and the light-receiver of the photo interrupter. Accordingly, light transmission from the light-emitter to the light-receiver is interrupted, and the resist sensor 69 turns to an OFF state.

[Description of Recording Head 10]

The structure of the recording head 10 provided in the printer 3 is described hereafter by way of FIGS. 4 and 5A to 5C.

Referring to FIG. 2, the recording head 10 includes the four ink nozzle groups 10*a* to 10*d* installed facing downward. From the ink nozzle groups 10*a* to 10*d*, four colors of ink (black, cyan, yellow, magenta) are ejected downward so that a recording is made onto the sheet.

Each of the ink nozzle groups 10*a* to 10*d* is constituted from ink nozzles (not shown) that eject an ink of a single color arranged in the sheet delivery direction. The ink nozzle groups 10*a* to 10*d* are arranged in order in the moving direction of the carriage 11. For example, each ink nozzle group is composed of 150 ink nozzles.

The recording head 10 has internal sub-tanks 101*a* to 101*d*, each of which stores one of the four colors of ink. These sub-tanks 101*a* to 101*d* and the ink nozzle groups 10*a* to 10*d* are connected via a tube or the like per color so that the ink of the respective colors can be supplied from the sub-tanks 101*a* to 101*d* to the ink nozzle groups 10*a* to 10*d*.

The sub-tanks 101*a* to 101*d* are the same in structure. Therefore, in the following description, only the structure of the sub-tank 101*a* for one specific color of ink will be explained in detail. Descriptions of the sub-tanks 101*b* to 101*d* for the other colors of ink are arbitrarily omitted. The same applies to the ink nozzle groups 10*a* to 10*b*, the ink cartridges 21*a* to 21*d*, the ink tubes 22*a* to 22*d*, and the ink supply mechanisms 151*a* to 151*d*.

Figure 4:
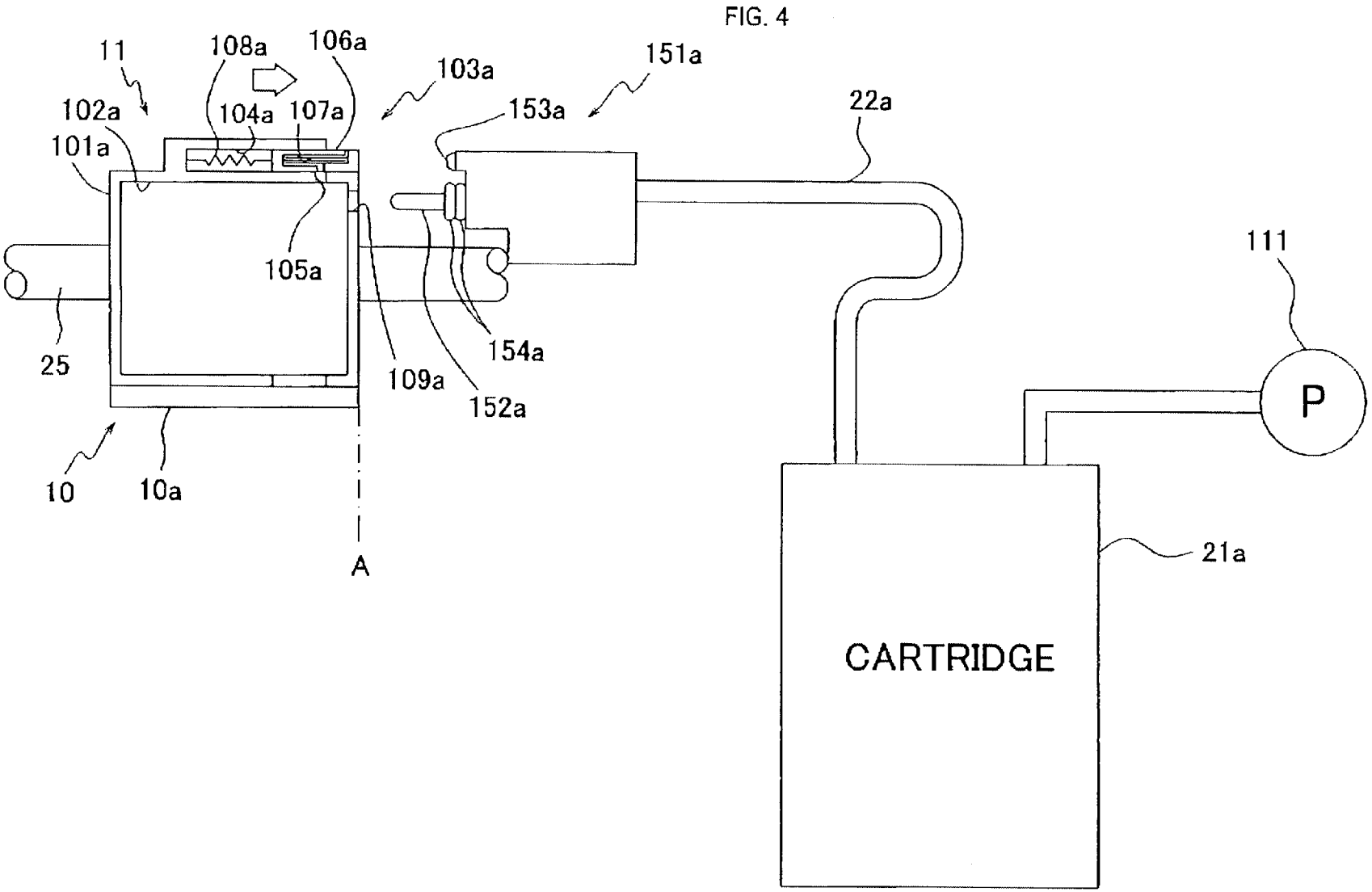
FIG. 4 is an explanatory view showing a schematic structure of a recording head and an ink supply mechanism according to a first embodiment.

Referring to FIG. 4, the sub-tank 101*a* is provided with a tank body 102*a* for storing ink, and an exhaust portion 103*a* for discharging the air inside the tank body 102*a* to the outside. The exhaust portion 103*a* includes a cavity portion 104*a*, an air communication hole 105*a*, a slider 106*a*, and a spring device 108*a*. The cavity portion 104*a* is formed on top of the recording head 10 and opens rightward. The air communication hole 105*a* communicates the tank body 102*a* with the atmosphere via the cavity portion 104*a*. At least a part of the slider 106*a* is disposed inside the cavity portion 104*a*. The slider 106*a* opens/closes the air communication hole 105*a*.

The cavity portion 104*a* is arranged to face a switching member 153*a* of the ink supply mechanism 151*a*. The cavity portion 104*a* communicates with the tank body 102*a* via the air communication hole 105*a*. Accordingly, the tank body 102*a* is communicated with the atmosphere via the cavity portion 104*a* and the air communication hole 105*a*.

The slider 106*a* can be moved in the horizontal direction inside the cavity portion 104*a*. The slider 106*a* is pressed rightward by the spring device 108*a*, which is also disposed inside the cavity portion 104*a*. The slider 106*a* has a communication hole 107*a*. The communication hole 107*a* is formed as a labyrinth and is constituted as follows. That is, when the slider 106*a* is moved rightward by a biasing force of the spring device 108*a*, the communication hole 107*a* allows the air communication hole 105*a* to be communicated with the atmosphere (communication position, see FIGS. 4 and 5A). On the other hand, when the slider 106*a* is pressed by the switching member 153*a* of the ink supply mechanism 151*a* due to the movement of the carriage 11 and is moved leftward against the biasing force of the spring device 108*a*, the communication hole 107*a* disallows the air communication hole 105*a* to be communicated with the atmosphere (non-communication position, see FIG. 5B).

The tank body 102*a* is provided with an ink supply opening 109*a* for receiving an ink supply from the ink supply nozzle 152*a*. The ink supply opening 109*a* is disposed to face the ink supply nozzle 152*a* of the ink supply mechanism 151*a*. The ink supply opening 109*a* can be attached to/detached from the ink supply nozzle 152*a* by the movement of the carriage 11. The ink supply opening 109*a* includes an internal valve (not shown) that can seal the ink supply opening 109*a* when the ink supply nozzle 152*a* is separated from the ink supply opening 109*a*.

[Description of Ink Supply Mechanism 151*a*]

The structure of the ink supply mechanism 151*a* provided in the printer 3 is described hereinafter.

As shown in FIG. 4, the ink supply mechanism 151*a* includes an ink supply nozzle 152*a* for supplying ink to the tank body 102*a* of the sub-tank 101*a*, and the switching member 153*a* for pressing the slider 106*a* of the exhaust portion 103*a* provided in the recording head 10. The ink supply nozzle 152*a* is arranged to face the ink supply opening 109*a* of the sub-tank 101*a*. The ink supply nozzle 152*a* can be attached to/detached from the ink supply opening 109*a* of the sub-tank 101*a* by the movement of the carriage 11. Two packings 154*a*, such as O-rings for sealing, are attached to the ink supply nozzle 152*a*. The switching member 153*a* is arranged to face the slider 106*a* of the exhaust portion 103*a* provided in the recording head 10. The switching member 153*a* can be attached to/detached from the slider 106*a* by the movement of the carriage 11.

The positional relationship between the slider 106*a* and the ink supply opening 109*a* provided in the recording head 10, and the switching member 153*a* and the ink supply nozzle 152*a* provided in the ink supply mechanism 151*a*, is set as follows. That is, the recording head 10 and the ink supply mechanism 151*a* can be brought into the following states (1-1) to (1-3) by moving the carriage 11 (recording head 10) in the horizontal direction through the driving force of the carriage motor 30.

(1-1) The slider 106*a* of the recording head 10 and the switching member 153*a* of the ink supply mechanism 151*a* are separated. The tank body 102*a* of the sub-tank 101*a* is communicated with the atmosphere via the air communication hole 105*a* and the communication hole 107*a*. The ink supply nozzle 152*a* of the ink supply mechanism 151*a* is not connected to the ink supply opening 109*a* of the recording head 10 (see FIG. 4).

(1-2) The slider 106*a* of the recording head 10 is pressed by the switching member 153*a* of the ink supply mechanism 151*a* and moved leftward. The tank body 102*a* of the sub-tank 101*a* is still communicated with the atmosphere via the air communication hole 105*a* and the communication hole 107*a*. The ink supply nozzle 152*a* of the ink supply mechanism 151*a* is connected to the ink supply opening 109*a* of the recording head 10 so that ink can be supplied from the ink cartridge 21*a* to the sub-tank 101*a* (see FIG. 5A).

(1-3) The slider 106*a* of the recording head 10 is pressed by the switching member 153*a* of the ink supply mechanism 151*a* and moved further leftward. The tank body 102*a* of the sub-tank 101*a* is no longer communicated with the atmosphere. The ink supply nozzle 152*a* of the ink supply mechanism 151*a* is connected to the ink supply opening 109*a* of the recording head 10 so that ink can be supplied from the ink cartridge 21*a* to the sub-tank 101*a* (see FIG. 5B).

[Description of Control Processor 70 (Control System of Printer 3)]

Figure 3:
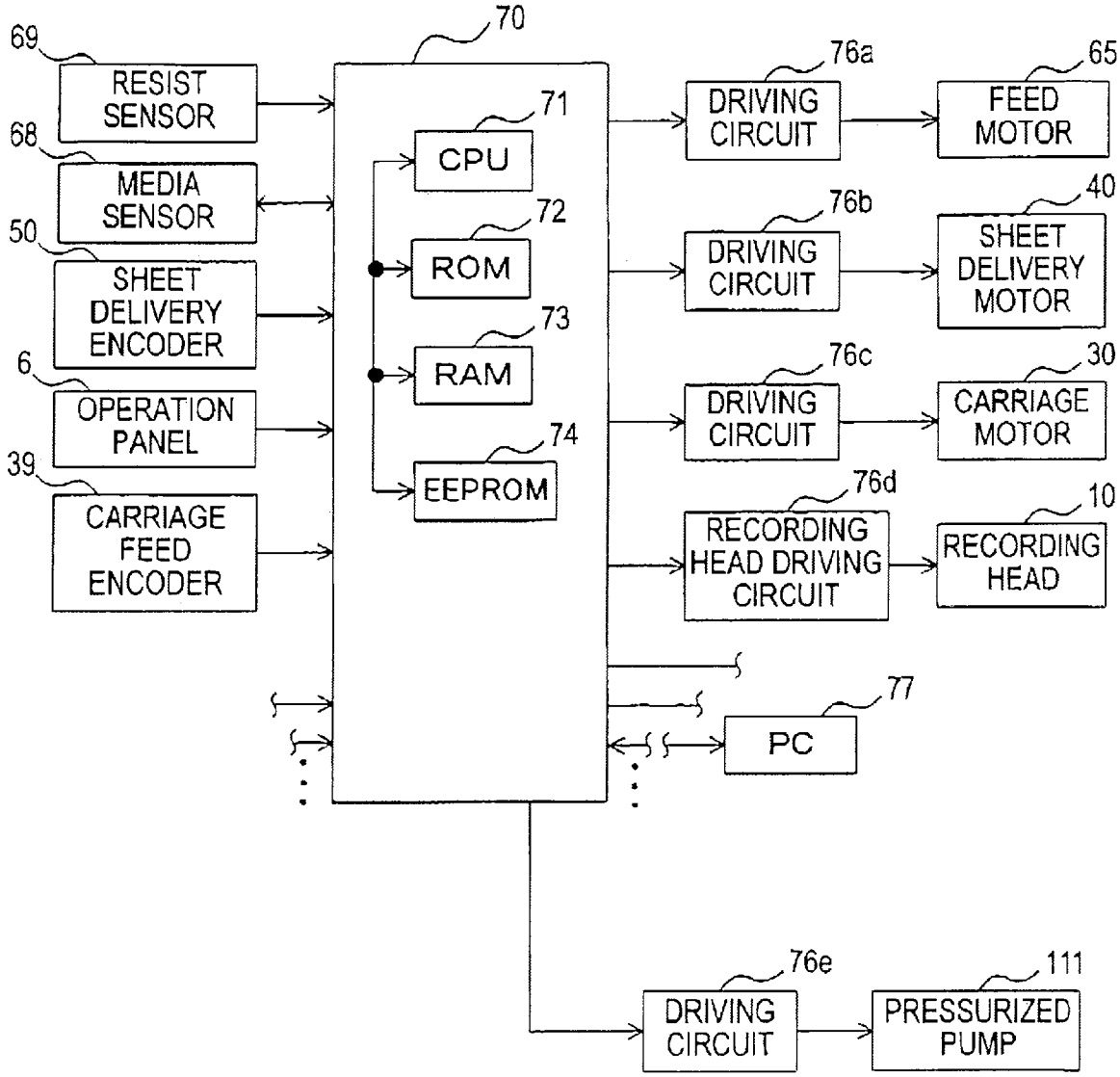
FIG. 3 is a block diagram showing a schematic structure of a control processor.

The structure of the control processor 70 is described hereinafter by way of FIG. 3. FIG. 3 is a block diagram showing a schematic structure of the control processor 70.

Referring to FIG. 3, the control processor 70 includes a microcomputer provided with CPU 71, ROM 72, RAM 73, and EEPROM 74. The resist sensor 69, the media sensor 68, the sheet delivery encoder 50, the operation panel 6, and the carriage feed encoder 39 are electrically connected to the control processor 70.

Also, driving circuits 76*a* to 76*c* for respectively driving the feed motor 65, the sheet delivery motor 40, and the carriage motor 30, a recording head driving circuit 76*d* for driving the recording head 10, and a driving circuit 76*e* for driving a pressurized pump 111 are electrically connected to the control processor 70. A personal computer 77 (PC 77) can be also connected to the control processor 70

When the control processor 70 (more particularly, CPU 71) receives instructions for recording onto a sheet P from the PC 77 or from other functioning blocks such as for copying, faxing, etc. of the multifunctional apparatus 1, a sheet end detection process that detects an end position of the sheet P is initially performed. Then, based on results of the detection, a recording process that records an image onto the sheet P is performed. If recording to the next page is necessary, the sheet end detection process and the recording process are performed again with respect to another sheet P for the next page. If recording to the next page is not necessary, the process is ended. In this manner, image forming onto the sheet P is performed. The sheet end detection process and the recording process herein follow the well-known techniques in the art. Therefore, detailed explanation thereof is omitted.

The control processor 70 can supply four colors of ink from the ink cartridges 21*a* to 21*d* to the sub-tanks 101*a* to 101*d* of the recording head 10 by driving the pressurized pump 111 via the driving circuit 76*e*.

The control processor 70 moves the carriage 11 (recording head 10) in the horizontal direction by controlling the carriage motor 30. The control processor 70 can bring the recording head 10 and the ink supply mechanisms 151*a* to 151*d* into the aforementioned states (1-1) to (1-3) by changing the relative position between the recording head 10 and the ink supply mechanisms 151*a* to 151*d*.

[Description of Operation of Carriage Mechanism]

The operation of the carriage mechanism performed by the control processor 70 is explained by way of FIGS. 4 and 5A to 5C.

During standby, the carriage motor 30 is driven to move the carriage 11 rightward. The ink supply nozzle 152*a* is connected to the ink supply opening 109*a*. Also, the switching member 153*a* moves the slider 106*a* leftward against the biasing force of the spring device 108*a*. However, the air connection hole 105*a* is still communicated with the atmosphere (ink supply position, see FIG. 5A, in FIGS. 5A and 5C, the end position of the recording head 10 in the ink supply position is indicated by a reference symbol "B"). In this case, ink can be supplied from the ink cartridge 21*a* to the sub-tank 101*a* of the recording head 10 by driving the pressurized pump 111 (standby mode and ink supply mode, see FIGS. 5A and 5C).

Now, in order to perform image recording onto the sheet, the carriage motor 30 is driven to move the carriage 11 leftward. The ink supply nozzle 152*a* is separated from the ink supply opening 109*a*. The switching member 153*a* is separated from the slider 106*a* (recording position, see FIG. 4, in FIGS. 4 and 5A to 5C, the end position of the recording head 10 in the recording position is indicated by a reference symbol "A"). In this case, the ink supply opening 109*a* is sealed with the internal valve, while the air communication hole 105*a* continues to be communicated with the atmosphere (recording (printing) mode, see FIGS. 4 and 5C). The carriage 11 is moved further leftward by driving the carriage motor 30, and the aforementioned sheet end detection process and recording process are executed.

On the other hand, in order to recover ink discharge performance of the recording head 10, the carriage motor 30 is driven to move the carriage 11 further rightward. The ink supply nozzle 152*a* is connected to the ink supply opening 109*a*. Also, the switching member 153*a* moves the slider 106*a* leftward against the biasing force of the spring device 108*a*, such that the communication hole 107*a* of the slider 106*a* and the air communication hole 105*a* are no longer communicated (discharge performance recovery position, see FIG. 5B, in FIGS. 5A to 5C, the end portion of the recording head 10 at the discharge performance recovery position is indicated by a reference symbol "C"). Even after the ink supply nozzle 152*a* is connected to the ink supply opening 109*a*, the carriage 11 can be moved further rightward due to the elasticity of the packings 154*a*. In this case, ink can be supplied from the ink cartridge 21*a* to the sub-tank 101*a* of the recording head 10 by driving the pressurized pump 111 (during discharge performance recovery (positive pressure purge), see FIGS. 5B and 5C). The ink discharge performance by the ink nozzle group 10*a* of the recording head 10 can be recovered by discharging ink from the ink nozzle group 10*a*.

[Effects]

According to the first embodiment, the following effects can be achieved. In the multifunctional apparatus 1, one pressurized portion such as the pressurized pump 111 is used. Also, the recording head 10 includes the slider 106*a* that opens/closes the air communication hole 105*a* of the sub-tank 101*a*. Furthermore, the switching member 153*a* is provided that switches the communication state between the air communication hole 105*a* and the atmosphere by moving the slider 106*a*. The switching member 153*a* is integrally formed with the ink supply mechanism 151*a*. Accordingly, depending on the relative position between the sub-tank 101*a* of the recording head 10 and the ink supply mechanisms 151*a*, the operation mode of the printer 3 can be easily switched to at least the following three modes: (a) "recording mode" that enables image recording onto a sheet; (b) "ink supply mode (standby mode)" in which the sub-tank 101*a* is supplied with ink; and (c) "discharge performance recovery mode" in which the discharge performance of the ink nozzle group 10*a* of the recording head 10 is recovered. Therefore, the multifunctional apparatus 1 can be composed of a fewer number of parts, and easily controlled as compared to the conventional ink jet recording apparatus.

According to the multifunctional apparatus 1 of the first embodiment, the control processor 70 controls the carriage motor 30 to move the carriage 11 (recording head 10) in the horizontal direction, so that the relative position between the sub-tank 101*a* of the recording head 10 and the ink supply mechanism 151*a* can be modified. Therefore, while the load to the carriage motor 30 is increased, the multifunctional apparatus 1 can be composed of a fewer number of parts since no additional driving mechanism is necessary for moving the ink supply mechanism 151*a*.

According to the multifunctional apparatus 1 of the first embodiment, the ink supply opening 109*a* has an internal valve that can seal the ink supply opening 109*a* when the ink supply nozzle 152*a* is separated from the ink supply opening 109*a*. Therefore, even if the multifunctional apparatus 1 is accidentally placed upside down, leakage of ink can be prevented as much as possible.

Second Embodiment

In the first embodiment, the control processor 70 controls the carriage motor 30 to move the carriage 11 (recording head 10) in the horizontal direction. Depending on the relative position between the sub-tank 101*a* of the recording head 10 and the supply mechanism 151*a*, the control processor 70 easily switches the operation mode of the printer 3 to the three modes: (a) "recording mode"; (b) "ink supply mode (standby mode)"; and (c) "discharge performance recovery mode". In addition to the aforementioned three operation modes, the control processor 70 in the second embodiment shown in FIGS. 6 and 7A to 7C is designed to easily switch the operation mode of the printer 3 to a fourth operation mode: (d) "long-term storage mode" in which the ink inside the sub-tank 221*a* of the recording head 210 is to be stored for a long period of time.

Hereinafter, the structure of the multifunctional apparatus 1 according to the second embodiment is described by way of FIGS. 6 and 7A to 7C. Many of the components are common in both the first and second embodiments. Therefore, the same reference numbers are given to identical components, and descriptions thereof are not repeated.

[Description of Recording Head 210]

Figure 6:
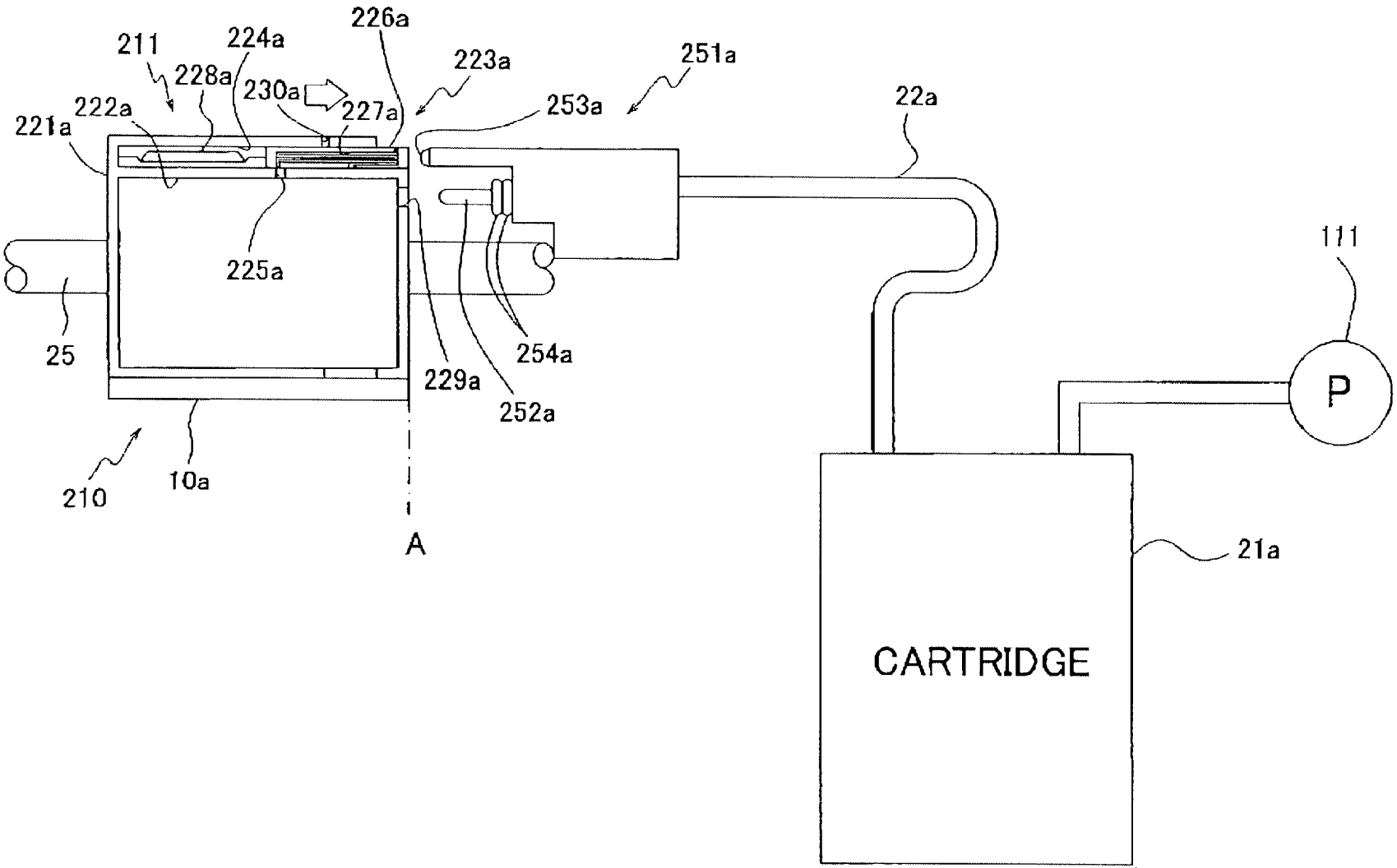
FIG. 6 is an explanatory view showing a schematic structure of a recording head and an ink supply mechanism according to a second embodiment.

As shown in FIG. 6, a recording head 210 has internal sub-tanks 221*a* to 221*d* (only 221*a* is shown in this figure), each of which stores one of four colors of ink. The sub-tanks 221*a* to 221*d* are the same in structure. Therefore, in the following description, only the structure of the sub-tank 221*a* for one specific color of ink will be explained in detail. Descriptions of the sub-tanks 221*b* to 221*d* for the other colors of ink are arbitrarily omitted. The same applies to ink supply mechanisms 251*a* to 251*d*. The sub-tank 221*a* is provided with a tank body 222*a* for storing ink, and an exhaust portion 223*a* for discharging the air inside the tank body 222*a* to the outside. The exhaust portion 223*a* includes a cavity portion 224*a*, an air communication hole 225*a*, a slider 226*a*, and a spring device 228*a*. The cavity portion 224*a* is formed on top of the recording head 210 and opens rightward. The air communication hole 225*a* communicates the tank body 222*a* with the atmosphere via the cavity portion 224*a*. At least a part of the slider 226*a* is disposed inside the cavity portion 224*a*. The slider 226*a* opens/closes the air communication hole 225*a*.

The cavity portion 224*a* is arranged to face a switching member 253*a* of the later-explained ink supply mechanism 251*a*. The cavity portion 224*a* communicates with the tank body 222*a* via the air communication hole 225*a*. Accordingly, the tank body 222*a* is communicated with the atmosphere via the cavity portion 224*a* and the air communication hole 225*a*. The cavity portion 224*a* is also provided with a cavity communication hole 230*a* that communicates the cavity portion 224*a* with the atmosphere.

The slider 226*a* can be moved in the horizontal direction inside the cavity portion 224*a*. The slider 226*a* is pressed rightward by the spring device 228*a*, which is also disposed inside the cavity portion 224*a*. The slider 226*a* has a communication hole 227*a* The communication hole 227*a* is formed as a labyrinth and is constituted as follows. That is, when the slider 226*a* is moved rightward by a biasing force of the spring device 228*a*, the communication hole 227*a* allows the air communication hole 225*a* to be communicated with the atmosphere (communication position, see FIG. 6). When the slider 226*a* is pressed with the switching member 253*a* of the ink supply mechanism 251*a* by the movement of a carriage 211 and moved leftward against the biasing force of the spring device 228*a*, the communication hole 227*a* disallows the air communication hole 225*a* to be communicated with the atmosphere (non-communication position, see FIG. 7A). When the slider 226*a* is pressed with the switching member 253*a* of the ink supply mechanism 251*a* by the movement of the carriage 211 and is moved further leftward against the biasing force of the spring device 228*a*, the communication hole 227*a* allows the air communication hole 225*a* to be communicated with the atmosphere via the cavity communication hole 230*a* of the cavity portion 224*a* (communication position, see FIG. 7B). When the slider 226*a* is pressed with the switching member 253*a* of the ink supply mechanism 251*a* by the movement of the carriage 211 and is moved much further leftward against the biasing force of the spring device 228*a*, the communication hole 227*a* again disallows the air communication hole 225*a* to be communicated with the atmosphere (non-communication position, see FIG. 7C).

The tank body 222*a* is provided with an ink supply opening 229*a* for receiving ink supply from an ink supply nozzle 252*a*. The ink supply opening 229*a* is disposed to face the ink supply nozzle 252*a* of the ink supply mechanism 251*a*. The ink supply opening 229*a* can be attached to/detached from the ink supply nozzle 252*a* by the movement of the carriage 211. The ink supply opening 229*a* includes an internal valve (not shown) that can seal the ink supply opening 229*a* when the ink supply nozzle 252*a* is separated from the ink supply opening 229*a*.

[Description of Ink Supply Mechanism 251*a*]

As shown in FIG. 6, the ink supply mechanism 251*a* includes an ink supply nozzle 252*a* for supplying ink to the tank body 222*a* of the sub-tank 221*a*, and the switching member 253*a* for pressing the slider 226*a* of the exhaust portion 223*a* provided in the recording head 210. The ink supply nozzle 252*a* is arranged to face the ink supply opening 229*a* of the sub-tank 221*a*. The ink supply nozzle 252*a* can be attached to/detached from the ink supply opening 229*a* of the sub-tank 221*a* by the movement of the carriage 211. Two packings 254*a*, such as O-rings for sealing, are attached to the ink supply nozzle 252*a*. The switching member 253*a* is arranged to face the slider 226*a* of the exhaust portion 223*a* provided in the recording head 210. The switching member 253*a* can be attached to/detached from the slider 226*a* by the movement of the carriage 211.

The positional relationship between the slider 226*a* and the ink supply opening 229*a* provided in the recording head 210, and the switching member 253*a* and the ink supply nozzle 252*a* provided in the ink supply mechanism 251*a*, is set as follows. That is, the recording head 210 and the ink supply mechanism 251*a* can be brought into the following states (2-1) to (2-4) by moving the carriage 211 (recording head 210) in the horizontal direction through the driving force of the carriage motor 30.

(2-1) The slider 226*a* of the recording head 210 and the switching member 253*a* of the ink supply mechanism 251*a* are separated. The tank body 222*a* of the sub-tank 221*a* is communicated with the atmosphere via the air communication hole 225*a* and the communication hole 227*a*. The ink supply nozzle 252*a* of the ink supply mechanism 251*a* is not connected to the ink supply opening 229*a* of the recording head 210 (see FIG. 6).

(2-2) The slider 226*a* of the recording head 210 is pressed by the switching member 253*a* of the ink supply mechanism 251*a* and moved leftward, such that the tank body 222*a* of the sub-tank 221*a* is no longer communicated with the atmosphere. The ink supply nozzle 252*a* of the ink supply mechanism 251*a* is not connected to the ink supply opening 229*a* of the recording head 210 (see FIG. 7A).

(2-3) The slider 226*a* of the recording head 210 is pressed by the switching member 253*a* of the ink supply mechanism 251*a* to move further leftward, such that the tank body 222*a* of the sub-tank 221*a* is again communicated with the atmosphere via the air communication hole 225*a* and the cavity communication hole 230*a*. The ink supply nozzle 252*a* of the ink supply mechanism 251*a* is connected to the ink supply opening 229*a* of the recording head 210 so that ink can be supplied from the ink cartridge 21*a* (see FIG. 6) to the sub-tank 221*a* (see FIG. 7B).

(2-4) The slider 226*a* of the recording head 210 is pressed by the switching member 253*a* of the ink supply mechanism 251*a* and moved much further leftward. The tank body 222*a* of the sub-tank 221*a* is no longer communicated with the atmosphere. The ink supply nozzle 252*a* of the ink supply mechanism 251*a* is connected to the ink supply opening 229*a* of the recording head 210 so that ink can be supplied from the ink cartridge 21*a* (see FIG. 6) to the sub-tank 221*a* (see FIG. 7C).

[Description of Control Processor 70]

The control processor 70 moves the carriage 211 (recording head 210) in the horizontal direction by controlling the carriage motor 30. The control processor 70 can bring the recording head 210 and the ink supply mechanisms 251*a* to 251*d* into the aforementioned states (2-1) to (2-4) by changing the relative position between the recording head 210 and the ink supply mechanisms 251*a* to 251*d*.

[Description of Operation of Carriage Mechanism]

In the second embodiment as described above, the control processor 70 operates carriage mechanism as follows.

During standby, the carriage motor 30 is driven to move the carriage 211 rightward. The ink supply nozzle 252*a* is connected to the ink supply opening 229*a*. While the switching member 253*a* moves the slider 226*a* rightward against the biasing force of the spring device 228*a*, the air connection hole 225*a* is communicated with the atmosphere via the communication hole 227*a* and the cavity communication hole 230*a* (ink supply position, see FIG. 7B, in FIGS. 7A to 7D, the end position of the recording head 210 in the ink supply position is indicated by the reference symbol "C"). In this case, ink can be supplied from the ink cartridge 21*a* (see FIG. 6) to the sub-tank 221*a* of the recording head 210 by driving the pressurized pump 111 (see FIG. 6) (standby mode and ink supply mode, see FIGS. 7B and 7D).

Here, in order to store the ink inside of the sub-tank 221*a* for a long period of time, the carriage motor 30 is driven to move the carriage 211 leftward. The ink supply nozzle 252*a* is separated from the ink supply opening 229*a*. While the switching member 253*a* still keeps the slider 226*a* leftward against the biasing force of the spring device 228, the communication hole 227*a* of the slider 226*a* is no longer communicated with the air communication hole 225*a* (long-term storage position, see FIGS. 7A and 7D, long-term storage mode, in FIGS. 7A to 7D, the end position of the recording head 210 in the long-term storage position is indicated by the reference symbol "B").

In order to perform image recording onto a sheet, the carriage motor 30 is driven to move the carriage 211 further leftward. The ink supply nozzle 252*a* is separated from the ink supply opening 229*a*. The switching member 253*a* is also separated from the slider 226*a* (recording position, see FIG. 6, in FIGS. 6 and 7A to 7C, the end position of the recording head 210 in the recording position is indicated by the reference symbol "A"). In this case, the ink supply opening 229*a* is sealed with the internal valve, while the air communication hole 225*a* continues to be communicated with the atmosphere (recording (printing) mode, see FIGS. 6 and 7B). The carriage 211 is moved further leftward by driving the carriage motor 30, and the aforementioned sheet end detection process and recording process are executed.

On the other hand, in order to recover a discharge performance of ink of the recording head 210, the carriage motor 30 is driven to move the carriage 211 further rightward. The ink supply nozzle 252*a* is connected to the ink supply opening 229*a*. The switching member 253*a* moves the slider 226*a* leftward against the biasing force of the spring device 228*a*, such that the communication hole 227*a* of the slider 226*a* and the air communication hole 225*a* are not communicated (discharge performance recovery position, see FIG. 7C, in FIGS. 7A to 7D, the end position of the recording head 210 at the discharge performance recovery position is indicated by a reference symbol "D"). Even after the ink supply nozzle 252*a* is connected to the ink supply opening 229*a*, the carriage 211 can be moved further rightward due to the elasticity of the packings 254*a*. In this case, ink can be supplied from the ink cartridge 21*a* to the sub-tank 221*a* of the recording head 210 by driving the pressurized pump 111 (during discharge performance recovery (positive pressure purge), see FIGS. 7C and 7D). The ink discharge performance by the ink nozzle group 10*a* of the recording head 210 can be recovered by discharging ink from the ink nozzle group 10*a*.

[Effects]

According to the second embodiment, the sub-tank 221*a* can be sealed by closing the air communication hole 225*a* with the slider 226*a*. Therefore, in addition to achieving the effects in the first embodiment, the second embodiment can cope with a long-term storage, such as shipping, of the multifunctional apparatus 1.

Third Embodiment

In the recording head 10 of the first embodiment, the slider 106*a* that opens/closes the air communication hole 105*a* of the sub-tank 101*a* is provided in a manner to be movable in the horizontal direction. Furthermore, the switching member 153*a*, which switches the communication state of the air communication hole 105*a* with the atmosphere by moving the slider 106*a*, is integrally formed with the ink supply mechanism 151*a*. In the third embodiment shown in FIGS. 8 and 9A to 9C, a switching member communication hole 355*a*, for switching the open/close state of the air communication hole 325*a* of a sub-tank 321*a*, is provided in a switching member 353*a* of an ink supply mechanism 351*a*.

Hereinafter, the structure of the multifunctional apparatus 1 according to the third embodiment is described by way of FIGS. 8 and 9A to 9C. Many of the components are common in both of the first and third embodiments. Therefore, the same reference numbers are given to identical components, and descriptions thereof are not repeated.

[Description of Recording Head 310]

Figure 8:
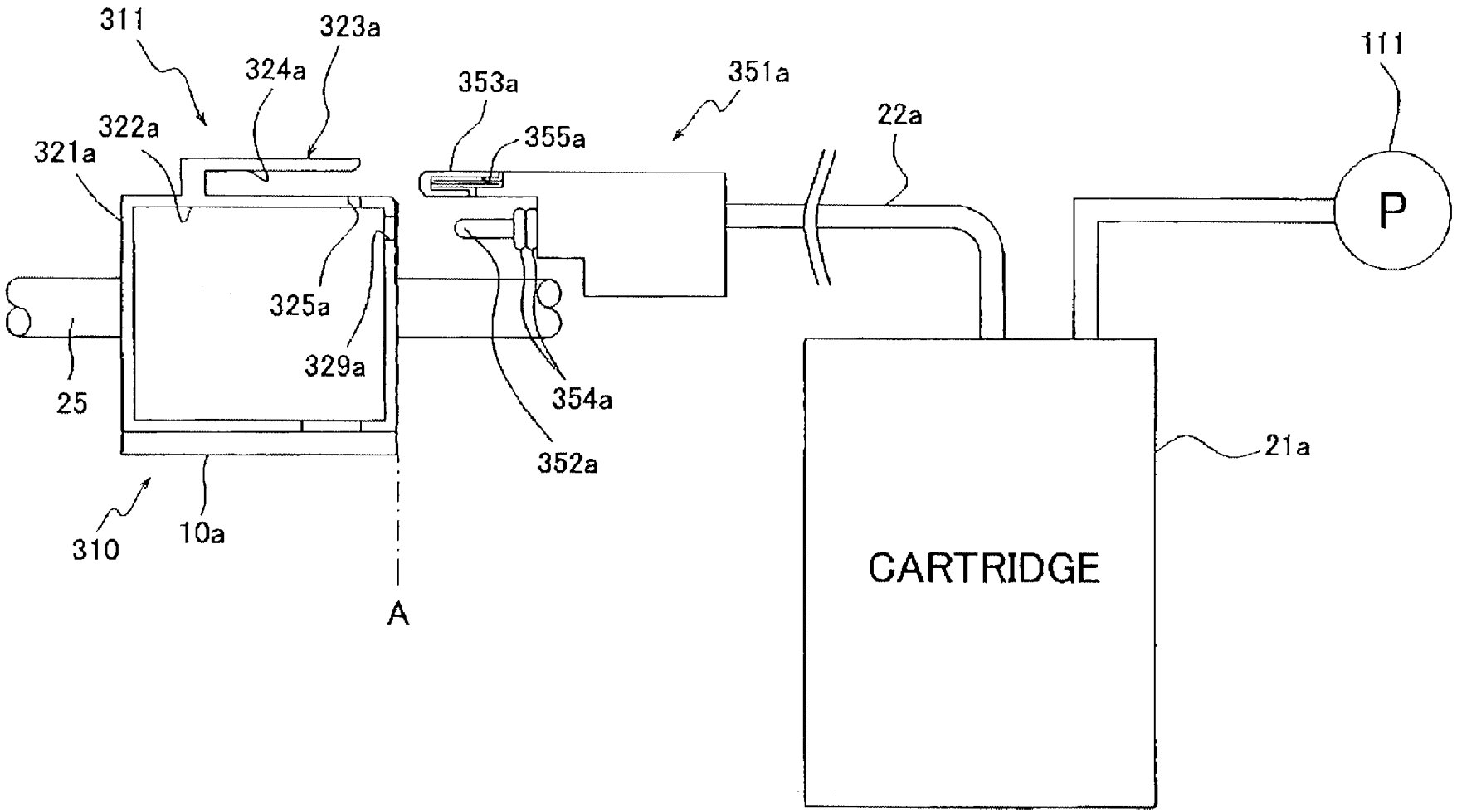
FIG. 8 is an explanatory view showing a schematic structure of a recording head and an ink supply mechanism according to a third embodiment.

As shown in FIG. 8, a recording head 310 has internal sub-tanks 321*a* to 321*d*, each of which stores one of four colors of ink. The sub-tanks 321*a* to 321*d* are the same in structure. Therefore, in the following description, only the structure of the sub-tank 321*a*, for one specific color of ink will be explained in detail. Descriptions of the sub-tanks 321*b* to 321*d* for the other colors of ink are arbitrarily omitted. The same applies to ink supply mechanisms 351*a* to 351*d*. The sub-tank 321*a* is provided with a tank body 322*a* for storing ink, and an exhaust portion 323*a* for discharging the air inside of the tank body 322*a* to the outside. The exhaust portion 323*a* includes a cavity portion 324*a*, and an air communication hole 325*a*. The cavity portion 324*a* is formed on the top of the recording head 310 and opens rightward. The air communication hole 325*a* communicates the tank body 322*a* with the atmosphere via the cavity portion 324*a*.

The cavity portion 324*a* is arranged to face a switching member 353*a* of the later-explained ink supply mechanism 351*a*. The cavity portion 324*a* communicates with the tank body 322*a* via the air communication hole 325*a*. Accordingly, the tank body 322*a* is communicated with the atmosphere via the cavity portion 324*a* and the air communication hole 325*a*.

The tank body 322*a* is provided with an ink supply opening 329*a* for receiving ink supply from an ink supply nozzle 352*a*. The ink supply opening 329*a* is disposed to face the ink supply nozzle 352*a* of the ink supply mechanism 351*a*. The ink supply opening 329*a* can be attached to/detached from the ink supply nozzle 352*a* by the movement of the carriage 311. The ink supply opening 329*a* includes an internal valve (not shown) that can seal the ink supply opening 329*a* when the ink supply nozzle 352*a* is separated from the ink supply opening 329*a*.

[Description of Ink Supply Mechanism 351*a*]

As shown in FIG. 8, the ink supply mechanism 351*a* includes an ink supply nozzle 352*a* for supplying ink to the tank body 322*a* of the sub-tank 321*a*, and the switching member 353*a* for switching the communication state of the air communication hole 325*a* of the exhaust portion 323*a* provided in the recording head 310. The ink supply nozzle 352*a* is arranged to face the ink supply opening 329*a* of the sub-tank 321*a*. The ink supply nozzle 352*a* can be attached to/detached from the ink supply opening 329*a* of the sub-tank 321*a* by the movement of the carriage 311. Two packings 354*a*, such as O-rings for sealing, are attached to the ink supply nozzle 252*a*. The switching member 353*a* is arranged to face the cavity 324*a* of the exhaust portion 323*a* provided in the recording head 310. The switching member 353*a* can be moved into the cavity portion 324*a* by the movement of the carriage 311. The switching member 353*a* has the switching member communication hole 355*a*. The switching member communication hole 355*a* is formed as a labyrinth and is constituted as follows. That is, when the switching member 353*a* is separated from the cavity portion 324*a* by the movement of the carriage 311, the switching member communication hole 355*a* allows the air communication hole 325*a* to be communicated with the atmosphere (communication position, see FIG. 8). When the switching member 353*a* is inserted into the cavity portion 324*a* by the movement of the carriage 311, the switching member communication hole 355*a* allows the air communication hole 325*a* to be communicated with the atmosphere (communication position, see FIG. 9A). When the switching member 353*a* is moved further into the cavity portion 324*a* by the movement of the carriage 311, switching member communication hole 355*a* disallows the air communication hole 325*a* to be communicated with the atmosphere (non-communication position, see FIG. 9B).

The positional relationship between the air communication hole 325*a* and the ink supply opening 329*a* provided in the recording head 310, and the switching member 353*a* and the ink supply nozzle 352*a* provided in the ink supply mechanism 351*a*, is set as follows. That is, the recording head 310 and the ink supply mechanism 351*a* can be brought into the following states (3-1) to (3-3) by moving the carriage 311 (recording head 310) in the horizontal direction through the driving force of the carriage motor 30.

(3-1) The switching member 353*a* is separated from the cavity portion 324*a*. The air communication hole 325*a* is communicated with the atmosphere. The ink supply nozzle 352*a* of the ink supply mechanism 351*a* is not connected to the ink supply opening 329*a* of the recording head 310 (communication position, see FIG. 8).

(3-2) The switching member 353*a* is inserted into the cavity portion 324*a*, such that the air communication hole 325*a* is communicated with the atmosphere via the switching member communication hole 355*a* of the switching member 353*a*. The ink supply nozzle 352*a* of the ink supply mechanism 351*a* is connected to the ink supply opening 329*a* of the recording head 310 so that ink can be supplied from the ink cartridge 21*a* to the sub-tank 321*a* (communication position, see FIG. 9A).

(3-3) The switching member 353*a* is inserted further into the cavity portion 324*a*. The air communication hole 325*a* is no longer communicated with the atmosphere. The ink supply nozzle 352*a* of the ink supply mechanism 351*a* is connected to the ink supply opening 329*a* of the recording head 310 so that ink can be supplied from the ink cartridge 21*a* to the sub-tank 321*a* (non-communication position, see FIG. 9B).

[Description of Control Processor 70]

The control processor 70 moves the carriage 311 (recording head 310) in the horizontal direction by controlling the carriage motor 30. The control processor 70 can bring the recording head 310 and the ink supply mechanisms 351*a* to 351*d* into the aforementioned states (3-1) to (3-3) by changing the relative position between the recording head 310 and the ink supply mechanisms 351*a* to 351*d*.

[Description of Operation of Carriage Mechanism]

In the third embodiment as described above, the control processor 70 operates the carriage mechanism as follows.

During standby, the carriage motor 30 is driven to move the carriage 311 rightward. The ink supply nozzle 352*a* is connected to the ink supply opening 329*a*. The switching member 353*a* is inserted into the cavity portion 324*a*, so that the air connection hole 325*a* is communicated with the atmosphere via the switching member communication hole 355*a* (ink supply position, see FIG. 9A, in FIGS. 9A to 9C, the end position of the recording head 310 in the ink supply position is indicated by the reference symbol "B"). In this case, ink can be supplied from the ink cartridge 21*a* to the sub-tank 321*a* of the recording head 310 by driving the pressurized pump 111 (see FIG. 8) (standby mode and ink supply mode, see FIGS. 9A and 9C).

Now, in order to perform image recording onto a sheet, the carriage motor 30 is driven to move the carriage 311 leftward. The ink supply nozzle 352*a* is separated from the ink supply opening 329*a*, and the switching member 353*a* is also separated from the cavity portion 324*a* (recording position, see FIG. 8, in FIGS. 8 and 9A to 9C, the end position of the recording head 310 in the recording position is indicated by the reference symbol "A"). In this case, the ink supply opening 329*a* is sealed with the internal valve) while the air communication hole 325*a* continues to be communicated with the atmosphere (recording (printing) mode, see FIGS. 8 and 9C). The carriage 311 is moved further leftward by driving the carriage motor 30. The aforementioned sheet end detection process and recording process are executed.

On the other hand, in order to recover the ink discharge performance of the recording head 310, the carriage motor 30 is driven to move the carriage 311 further rightward, such that the ink supply nozzle 352*a* is connected to the ink supply opening 329*a*. The switching member 353*a* is inserted further into the cavity portion 324*a*, such that the air communication hole 325*a* and the atmosphere are no longer communicated (discharge performance recovery position, see FIG. 9B, in FIGS. 9A to 9C, the end position of the recording head 310 at the discharge performance recovery position is indicated by the reference symbol "C"). Even after the ink supply nozzle 352*a* is connected to the ink supply opening 329*a*, the carriage 311 can be moved further rightward due to the elasticity of packings 354*a*. In this case, ink can be supplied from the ink cartridge 21*a* to the sub-tank 321*a* of the recording head 310 by driving the pressurized pump 111 (see FIG. 8) (during discharge performance recovery (positive pressure purge), see FIGS. 9B and 9C). The ink discharge performance by the ink nozzle group 10*a* of the recording head 310 can be recovered by discharging ink from the ink nozzle group 10*a*.

[Effects]

According to the third embodiment, the same effects as those described in the first embodiment can be achieved.

Fourth Embodiment

In the third embodiment, the switching member communication hole 355*a* for switching the open/close state of the air communication hole 325*a* of the sub-tank 321*a* is provided in the switching member 353*a* of the ink supply mechanism 351*a*. Also, the control processor 70 controls the carriage motor 30 to move the carriage 311 (recording head 310) in the horizontal direction, and, depending on the relative position between the sub-tank 321*a* of the recording head 310 and the supply mechanism 351*a*, the control processor 70 easily switches the operation mode of the printer 3 to the three modes: (a) "recording mode"; (b) "ink supply mode (standby mode)"; and (c) "discharge performance recovery mode". In addition to the aforementioned three operation modes, the control processor 70 in the fourth embodiment shown in FIGS. 10 and 11A to 11D is designed to easily switch the operation mode of the printer 3 to a fourth operation mode: (d) "long-term storage mode" in which the ink inside the sub-tank 321*a* of the recording head 310 is to be stored for a long period of time.

Figure 10:
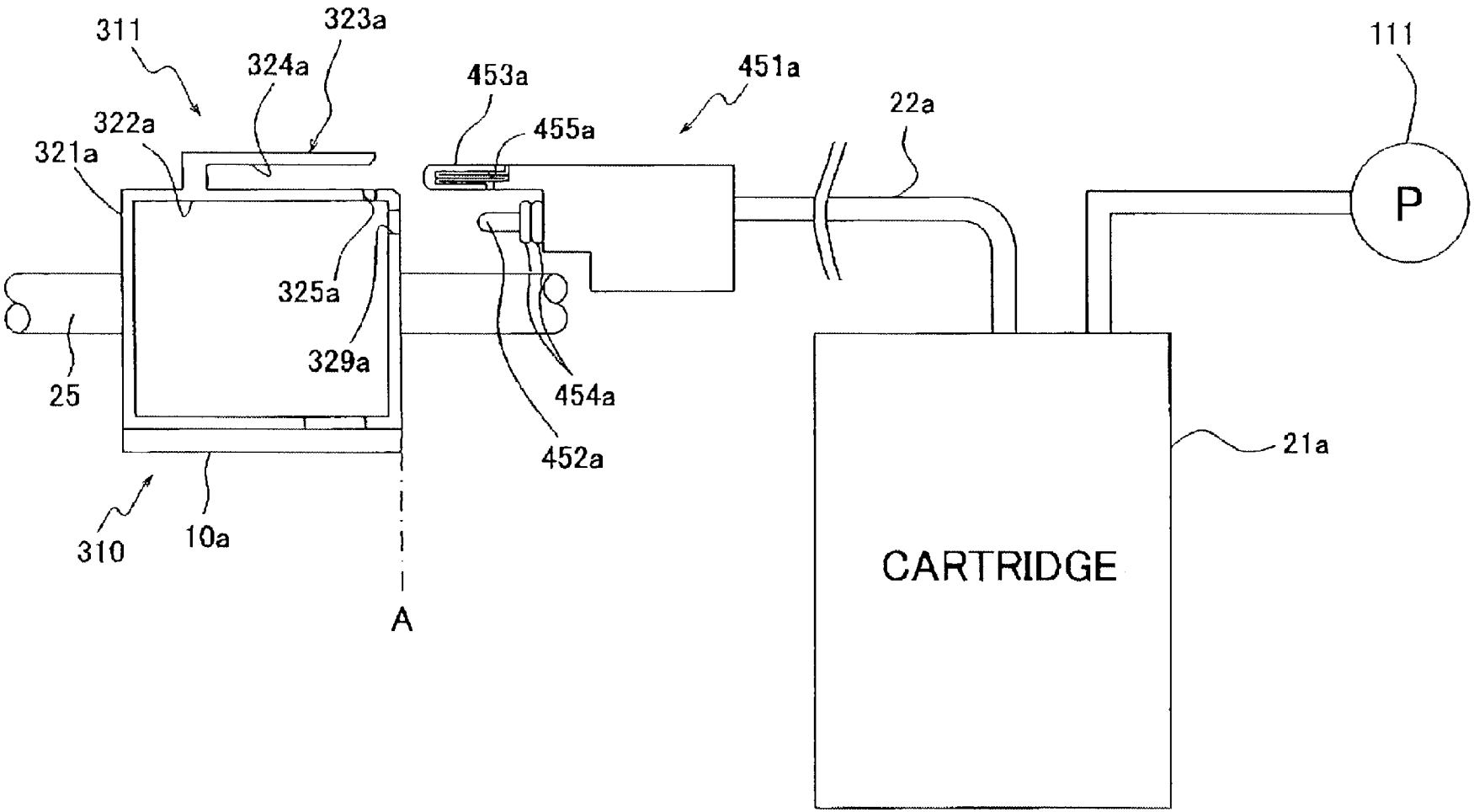
FIG. 10 is an explanatory view showing a schematic structure of a recording head and an ink supply mechanism according to a fourth embodiment.

Hereinafter, the structure of the multifunctional apparatus 1 according to the fourth embodiment is described by way of FIGS. 10 and 11A to 11D. Many of the components are common in both the third and fourth embodiments. Therefore, the same reference numbers are given to identical components, and descriptions thereof are not repeated. Also, ink supply mechanisms 451*a* to 451*d* (only ink supply mechanism 451*a* is shown in FIG. 10) are the same in structure. Accordingly, in the following description, only the structure of the ink supply mechanism 451*a* for one specific color of ink will be given, and descriptions on the ink supply mechanisms 451*b* to 451*d* for the other colors of ink are arbitrarily omitted.

[Description of Ink Supply Mechanism 451*a*]

As shown in FIG. 10, the ink supply mechanism 451*a* includes an ink supply nozzle 452*a* for supplying ink to the tank body 322*a* of the sub-tank 321*a*, and the switching member 453*a* for switching the communication state of the air communication hole 325*a* of the exhaust portion 323*a* is provided in the recording head 310. The ink supply nozzle 452*a* is arranged to face the ink supply opening 329*a* of the sub-tank 321*a*. The ink supply nozzle 452*a* can be attached to/detached from the ink supply opening 329*a* of the sub-tank 321*a* by the movement of the carriage 311. Two packings 454*a*, such as O-rings for sealing, are attached to the ink supply nozzle 452*a*. The switching member 453*a* is arranged to face the cavity portion 324*a* of the exhaust portion 323*a* provided in the recording head 310. The switching member 453*a* can be moved into the cavity portion 324*a* by the movement of the carriage 311. The switching member 453*a* has a switching member communication hole 455*a*. The switching member communication hole 455*a* is formed as a labyrinth and is constituted as follows. That is, when the switching member 453*a* is separated from the cavity portion 324*a* by the movement of the carriage 311, the switching member communication hole 455*a* allows the air communication hole 325*a* to be communicated with the atmosphere (communication position, see FIG. 10). When the switching member 453*a* is inserted into the cavity portion 324*a* by the movement of the carriage 311, the switching member communication hole 455*a* and the air communication hole 325*a* are no longer communicated. Thus, the air communication hole 325*a* is not communicated with the atmosphere (non-communication position, see FIG. 11A). When the switching member 453*a* is moved further into the cavity portion 324*a* by the movement of the carriage 311, the switching member communication hole 455*a* and the air communication hole 325*a* are communicated again. Thus, the air communication hole 325*a* is communicated with the atmosphere (communication position, see FIG. 11B). When the switching member 453*a* is moved much further into the cavity portion 324*a* by the movement of the carriage 311, the switching member communication hole 455*a* and the air communication hole 325*a* are no longer communicated. Thus, the air communication hole 325*a* is not communicated with the atmosphere (non-communication position, see FIG. 11C).

The positional relationship between the air communication hole 325*a* provided in the recording head 310 and the ink supply opening 329*a*, and the switching member 453*a* provided in the ink supply mechanism 451*a* and the ink supply nozzle 452*a*, is set as follows. That is, the recording head 310 and the ink supply mechanism 451*a* can be brought into the following states (4-1) to (4-4) by moving the carriage 311 (recording head 310) in the horizontal direction through the driving force of the carriage motor 30.

(4-1) The switching member 453*a* is separated from the cavity portion 324*a*. The air communication hole 325*a* is communicated with the atmosphere. The ink supply nozzle 452*a* of the ink supply mechanism 451*a* is not connected to the ink supply opening 329*a* of the recording head 310 (communication position, see FIG. 10).

(4-2) The switching member 453*a* is inserted into the cavity portion 324*a*, such that the switching member communication hole 455*a* and the air communication hole 325*a* are not communicated. The air communication hole 325*a* is no longer communicated with the atmosphere. The ink supply nozzle 452*a* of the ink supply mechanism 451*a* is not connected to the ink supply opening 329*a* of the recording head 310 so that ink cannot be supplied from the ink cartridge 21*a* to the sub-tank 321*a* (non-communication position, see FIG. 11A).

(4-3) The switching member 453*a* is inserted further into the cavity portion 324*a*, such that the air communication hole 325*a* is communicated with the atmosphere. The ink supply nozzle 452*a* of the ink supply mechanism 451*a* is connected to the ink supply opening 329*a* of the recording head 310 so that ink can be supplied from the ink cartridge 21*a* to the sub-tank 321*a* (communication position, see FIG. 11B)

(4-4) The switching member 453*a* is inserted much further into the cavity portion 324*a*. The switching member communication hole 455*a* and the air communication hole 325*a* are no longer communicated. The air communication hole 325*a* is no longer communicated with the atmosphere. The ink supply nozzle 452*a* of the ink supply mechanism 451*a* is connected to the ink supply opening 329*a* of the recording head 310 so that ink can be supplied from the ink cartridge 21*a* to the sub-tank 321*a* (non-communication position, see FIG. 11C).

[Description of Control Processor 70]

The control processor 70 moves the carriage 311 (recording head 310) in the horizontal direction by controlling the carriage motor 30. The control processor 70 can bring the recording head 310 and the ink supply mechanisms 451*a* to 451*d* into the aforementioned states (4-1) to (4-4) by changing the relative position between the recording head 310 and the ink supply mechanisms 451*a* to 451*d*.

[Description of Operation of Carriage Mechanism]

In the fourth embodiment as described above, the control processor 70 operates the carriage mechanism as follows.

During standby, the carriage motor 30 is driven to move the carriage 311 rightward. The ink supply nozzle 452*a* is connected to the ink supply opening 329*a*. The switching member 453*a* is inserted into the cavity portion 324*a*, such that the air connection hole 325*a* is communicated with the atmosphere via the switching member communication hole 455*a* (ink supply position, see FIG. 11B, in FIGS. 11A to 11D, the end position of the recording head 310 in the ink supply position is indicated by the reference symbol "C"). In this case, ink can be supplied from the ink cartridge 21*a* to the sub-tank 321*a* of the recording head 310 by driving the pressurized pump 111 (see FIG. 10) (standby mode and ink supply mode, see FIGS. 11B and 11D).

Here, in order to store the ink inside the sub-tank 321*a* for a long period of time, the carriage motor 30 is driven to move the carriage 311 leftward, such that the ink supply nozzle 452*a* is separated from the ink supply opening 329*a*, and the switching member communication hole 455*a* and the air communication hole 325*a* are no longer communicated. The air communication hole 325*a* is no longer communicated with the atmosphere (long-term storage position, see FIGS. 11A and 11D, long-term storage mode, in FIGS. 11A to 11D, the end position of the recording head 310 in the long-term storage position is indicated by the reference symbol "B").

In order to perform image recording onto the sheet, the carriage motor 30 is driven to move the carriage 311 further leftward. The ink supply nozzle 452*a* is separated from the ink supply opening 329*a*. The switching member 453*a* is also separated from the cavity portion 324*a* (recording position, see FIG. 10, in FIGS. 10 and 11A to 11C, the end position of the recording head 310 in the recording position is indicated by the reference symbol "A"). In this case, the ink supply opening 329*a* is scaled with the internal valve, while the air communication hole 325*a* is communicated with the atmosphere (recording (printing) mode, see FIGS. 10 and 11D). The carriage 311 is moved further leftward by driving the carriage motor 30, and the aforementioned sheet end detection process and recording process are executed.

On the other hand, in order to recover a discharge performance of ink of the recording head 310, the carriage motor 30 is driven to move the carriage 311 further rightward. The ink supply nozzle 452*a* is connected to the ink supply opening 329*a*. The switching member 453*a* is inserted further into the cavity portion 324*a*, such that the switching member communication hole 455*a* and the air communication hole 325*a* are not communicated. The air communication hole 325*a* is no longer communicated with the atmosphere (discharge performance recovery position, see FIG. 11C, in FIGS. 11A to 11D, the end position of the recording head 310 at the discharge performance recovery position is indicated by the reference symbol "D"). Even after the ink supply nozzle 452*a* is connected to the ink supply opening 329*a*, the carriage 311 can be moved further rightward due to the elasticity of the packings 454*a*. In this case, ink can be supplied from the ink cartridge 21*a* to the sub-tank 321*a* of the recording head 310 by driving the pressurized pump 111 (see FIG. 10) (during discharge performance recovery (positive pressure purge), see FIGS. 11C and 11D). The ink discharge performance by the ink nozzle group 10*a* of the recording head 310 can be recovered by discharging ink from the ink nozzle group 10*a*.

[Effects]

According to the fourth embodiment, the sub-tank 321*a* can be sealed by closing the air communication hole 325*a* with the switching member 453*a*. Therefore, in addition to achieving the effects in the third embodiment, the fourth embodiment can cope with a long-term storage, such as shipping, of the multifunctional apparatus 1.

Fifth Embodiment

The control processor 70 of the first embodiment is designed to move the carriage 11 (recording head 10) by controlling the carriage motor 30, and change the relative position between the sub-tank 101*a* provided in the recording head 10 and the ink supply mechanism 151*a*. In the fifth embodiment shown in FIGS. 12 and 13A to 13C, a driving mechanism for moving an ink supply mechanism 551*a* is separately provided. The control processor 70 controls an ink supply mechanism driving motor 112 to move the ink supply mechanism 551*a* to and fro, and to change the relative position between a sub-tank 521*a* provided in a recording head 510 and the ink supply mechanism 551*a*.

Hereinafter, the structure of the multifunctional apparatus according to the fifth embodiment is described by way of FIGS. 12 and 13A to 13C. Many of the components are common in both of the first and fifth embodiments. Therefore, the same reference numbers are given to identical components, and descriptions thereof are not repeated.

[Description of Recording Head 510]

Figure 12:
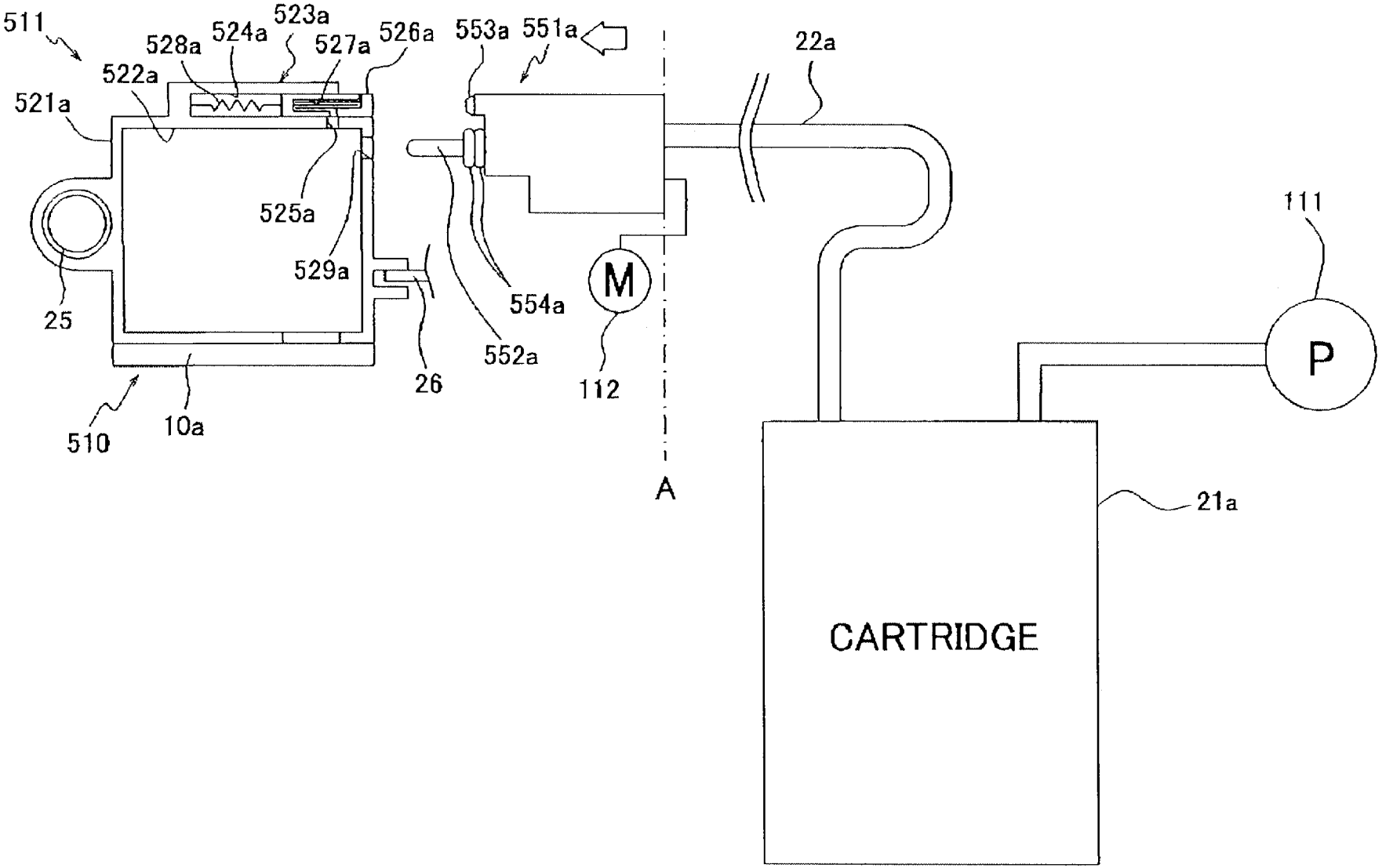
FIG. 12 is an explanatory view showing a schematic structure of a recording head and an ink supply mechanism according to a fifth embodiment.

As shown in FIG. 12, a recording head 510 has internal sub-tanks 521*a* to 521*d* (only internal sub-tank 521*a* is shown in FIG. 12), each of which stores one of four colors of ink. The sub-tanks 521*a* to 521*d* are the same in structure. Therefore) in the following description, only the structure of the sub-tank 521*a* for one specific color of ink will be explained in detail. Descriptions of the sub-tanks 521*b* to 521*d* for the other colors of ink are arbitrarily omitted. The same applies to ink supply mechanisms 551*a* to 551*d*. The sub-tank 521*a* is provided with a tank body 522*a* for storing ink, and an exhaust portion 523*a* for discharging the air inside the tank body 522*a* to the outside. The exhaust portion 523*a* includes a cavity portion 524*a*, an air communication hole 525*a*, a slider 526*a*, and a spring device 528*a*. The cavity portion 524*a* is formed on top of the recording head 510 and opens frontward. The air communication hole 525*a* communicates the tank body 522*a* with the atmosphere via the cavity portion 524*a*. At least a part of the slider 526*a* is disposed inside of the cavity portion 524*a*. The slider 526*a* opens/closes the air communication hole 525*a*.

The cavity portion 524*a* is arranged to face a switching member 553*a* of the later-explained ink supply mechanism 551*a*. The cavity portion 524*a* communicates with the tank body 522*a* via the air communication hole 525*a*. Accordingly, the tank body 522*a* is communicated with the atmosphere via the cavity portion 524*a* and the air communication hole 525*a*.

The slider 526*a* can be moved to the front and rear inside the cavity portion 524*a*. The slider 526*a* is pressed frontward by the spring device 528*a*, which is also disposed inside the cavity portion 524*a*. The slider 526*a* has a communication hole 527*a*. The communication hole 527*a* is formed as a labyrinth and is constituted as follows. That is, when the slider 526*a* is moved frontward by a biasing force of the spring device 528*a*, the communication hole 527*a* allows the air communication hole 525*a* to be communicated with the atmosphere (communication position, see FIG. 12). When the slider 526*a* is pressed with the switching member 553*a* by the movement of the ink supply mechanism 551*a* and is moved rearward against the biasing force of the spring device 528*a*, the communication hole 527*a* disallows the air communication hole 525*a* to be communicated with the atmosphere (non-communication position, see FIG. 13B)

The tank body 522*a* is provided with an ink supply opening 529*a* for receiving an ink supply from an ink supply nozzle 552*a*. The ink supply opening 529*a* is disposed to face the ink supply nozzle 552*a* of the ink supply mechanism 551*a*. The ink supply opening 529*a* can be attached to/detached from the ink supply nozzle 552*a* by the movement of the ink supply mechanism 551*a*. The ink supply opening 529*a* includes an internal valve (not shown) that can seal the ink supply opening 529*a* when the ink supply nozzle 552*a* is separated from the ink supply opening 529*a*.

[Description of Ink Supply Mechanism 551*a*]

As shown in FIG. 12, the ink supply mechanism 551*a* includes an ink supply nozzle 552*a* for supplying ink to the tank body 522*a* of the sub-tank 521*a*, and the switching member 553*a* for pressing the slider 526*a* of the exhaust portion 523*a* provided in the recording head 510. The ink supply mechanism 551*a* is disposed ahead of the carriage 511 (recording head 510) when the carriage 511 is located above the wiper or caps of the maintenance mechanism (given position). Also, the ink supply mechanism 551*a* can be moved to the front and rear by the driving force of the ink supply mechanism driving motor 112. The ink supply nozzle 552*a* is arranged to face the ink supply opening 529*a* of the sub-tank 521*a*. The ink supply nozzle 552*a* can be attached to/detached from the ink supply opening 529*a* of the sub-tank 521*a* by the movement of the ink supply mechanism 551*a*. Two packings 554*a*, such as O-rings for sealing, are attached to the ink supply nozzle 552*a*. The switching member 553*a* is arranged to face the slider 526*a* of the exhaust portion 523*a* provided in the recording head 510. The switching member 553*a* can be attached to/detached from the slider 526*a* by the movement of the ink supply mechanism 551*a*.

The positional relationship between the air communication hole 525*a* and the ink supply opening 529*a* provided in the recording head 510, and the switching member 553*a* and the ink supply nozzle 552*a* provided in the ink supply mechanism 551*a*, is set as follows. That is, the recording head 510 and the ink supply mechanism 551*a* can be brought into the following states (5-1) to (5-3) by moving the ink supply mechanism 551*a* to the front and rear by the driving force of the ink supply mechanism driving motor 112.

(5-1) The slider 526*a* of the recording head 510 and the ink supply mechanism 551*a* are separated. The tank body 522*a* of the sub-tank 521*a* is communicated with the atmosphere via the air communication hole 525*a* and the communication hole 527*a*. The ink supply nozzle 552*a* of the ink supply mechanism 551*a* is not connected to the ink supply opening 529*a* of the recording head 510 (communication position, see FIG. 12).

(5-2) The slider 526*a* of the recording head 510 is pressed with the switching member 553*a* of the ink supply mechanism 551*a* and moved rearward. The tank body 522*a* of the sub-tank 521*a* is still communicated with the atmosphere via the air communication hole 525*a* and the communication hole 527*a*. The ink supply nozzle 552*a* of the ink supply mechanism 551*a* is connected to the ink supply opening 529*a* of the recording head 510 so that ink can be supplied from the ink cartridge 21*a* to the sub-tank 521*a* (communication position, see FIG. 13A).

(5-3) The slider 526*a* of the recording head 510 is pressed with the switching member 553*a* of the ink supply mechanism 551*a* and moved further rearward. The tank body 522*a* of the sub-tank 521*a* is no longer communicated with the atmosphere. The ink supply nozzle 552*a* of the ink supply mechanism 551*a* is connected to the ink supply opening 529*a* of the recording head 510 so that ink can be supplied from the ink cartridge 21*a* to the sub-tank 521*a* (non-communication position, see FIG. 13B).

[Description of Control Processor 70]

The control processor 70 moves the ink supply mechanisms 551*a* to 551*d* to the front and rear by controlling the ink supply mechanism driving motor 112 via a driving circuit (not shown). The control processor 70 can bring the recording head 510 and the ink supply mechanisms 551*a* to 551*d* into the aforementioned states (5-1) to (5-3) by changing the relative position between the recording head 510 and the ink supply mechanisms 551*a* to 551*d*.

[Description of Operation of Ink Supply Mechanism 551*a*]

In the fifth embodiment as described above, the control processor 70 operates the ink supply mechanism 551*a* as follows.

During standby when the carriage 511 (recording head 510) is located above the wiper and caps of the maintenance mechanism (given position), the ink supply mechanism driving motor 112 is driven to move the ink supply mechanism 551*a* rearward. The ink supply nozzle 552*a* is connected to the ink supply opening 529*a*. While the switching member 553*a* moves the slider 526*a* rearward against a biasing force of the spring device 528*a*, the air connection hole 525*a* is communicated with the atmosphere (ink supply position, see FIG. 13A, in FIGS. 13A to 13C, the end position of the ink supply mechanism 551*a* in the ink supply position is indicated by the reference symbol "B"). In this case, ink can be supplied from the ink cartridge 21*a* to the sub-tank 521*a* of the recording head 510 by driving the pressurized pump 111 (see FIG. 12) (standby mode and ink supply mode, see FIGS. 13A and 13C)

Now, in order to perform image recording onto a sheet, the ink supply mechanism motor 112 is driven to move the ink supply mechanism 551*a* frontward. The ink supply nozzle 552*a* is separated from the ink supply opening 529*a*. The switching member 553*a* is also separated from the slider 526*a* (recording position, see FIG. 12, in FIG. 12, the end position of the ink supply mechanism 551*a* in the recording position is indicated by the reference symbol "A"). In this case, the ink supply opening 529*a* is sealed with the internal valve, while the air communication hole 525*a* continues to be communicated with the atmosphere (recording (printing) mode, see FIGS. 12 and 13C). The carriage 511 is moved leftward by driving the carriage motor 30, and the aforementioned sheet end detection process and recording process are executed.

On the other hand, in order to recover an ink discharge performance of the recording head 510, the ink supply mechanism driving motor 112, when the carriage 511 (recording head 510) is above the wiper and the caps of the maintenance mechanism (given position), is driven to move the ink supply mechanism 551*a* further rearward. The ink supply nozzle 552*a* is connected to the ink supply opening 529*a*. The switching member 553*a* moves the slider 526*a* rearward against the biasing force of the spring device 528*a* such that the communication hole 527*a* of the slider 526*a* and the air communication hole 225*a* are not communicated (discharge performance recovery position, see FIG. 13B, in FIGS. 13A to 13C, the end position of the ink supply mechanism 551*a* at the discharge performance recovery position is indicated by the reference symbol "C"). Even after the ink supply nozzle 552*a* is connected to the ink supply opening 529*a*, the ink supply mechanism 551*a* can be moved further rearward due to the elasticity of packings 554*a*. In this cases ink can be supplied from the ink cartridge 21*a* to the sub-tank 521*a* of the recording head 510 by driving the pressurized pump 111 (see FIG. 12) (during discharge performance recovery (positive pressure purge), see FIGS. 13B and 13C). The ink discharge performance by the ink nozzle group 10*a* of the recording head 510 can be recovered by discharging ink from the ink nozzle group 10*a*.

[Effects]

In the fifth embodiment, the load to the carriage motor 30 is reduced since a supplementary driving mechanism for moving the ink supply mechanism 551*a* is provided. Accordingly, in addition to the effects described in the first embodiment, miniaturization and a longer operating life of the carriage motor 30 can be achieved.

Sixth Embodiment

In the recording head 510 of the fifth embodiment, the slider 526*a* that opens/closes the air communication hole 525*a* of the sub-tank 521*a* is provided in a manner to be movable to the front and rear. Furthermore, the switching member 553*a* that switches the communication state of the air communication hole 525*a* with the atmosphere by moving the slider 526*a* is integrally formed with the ink supply mechanism 551*a*. Moreover, a driving mechanism for moving the ink supply mechanism 551*a* is additionally provided. Thus, the control processor 70 moves the ink supply mechanism 551*a* to the front and rear by controlling the ink supply mechanism driving motor 112, and changes the relative position between the sub-tank 521*a* of the recording head 510 and the ink supply mechanism 551*a*. In the sixth embodiment shown in FIGS. 14 and 15A to 15C, a switching member communication hole 655*a* for switching the open/close state of the air communication hole 625*a* of a sub-tank 621*a* is provided in a switching member 653*a* of an ink supply mechanism 651*a*.

Hereinafter, the structure of the multifunctional apparatus according to the sixth embodiment is described by way of FIGS. 14 and 15A to 15C. Many of the components are common in both of the fifth and sixth embodiments. Therefore, the same reference numbers are given to identical components, and descriptions thereof are not repeated.

[Description of Recording Head 610]

Figure 14:
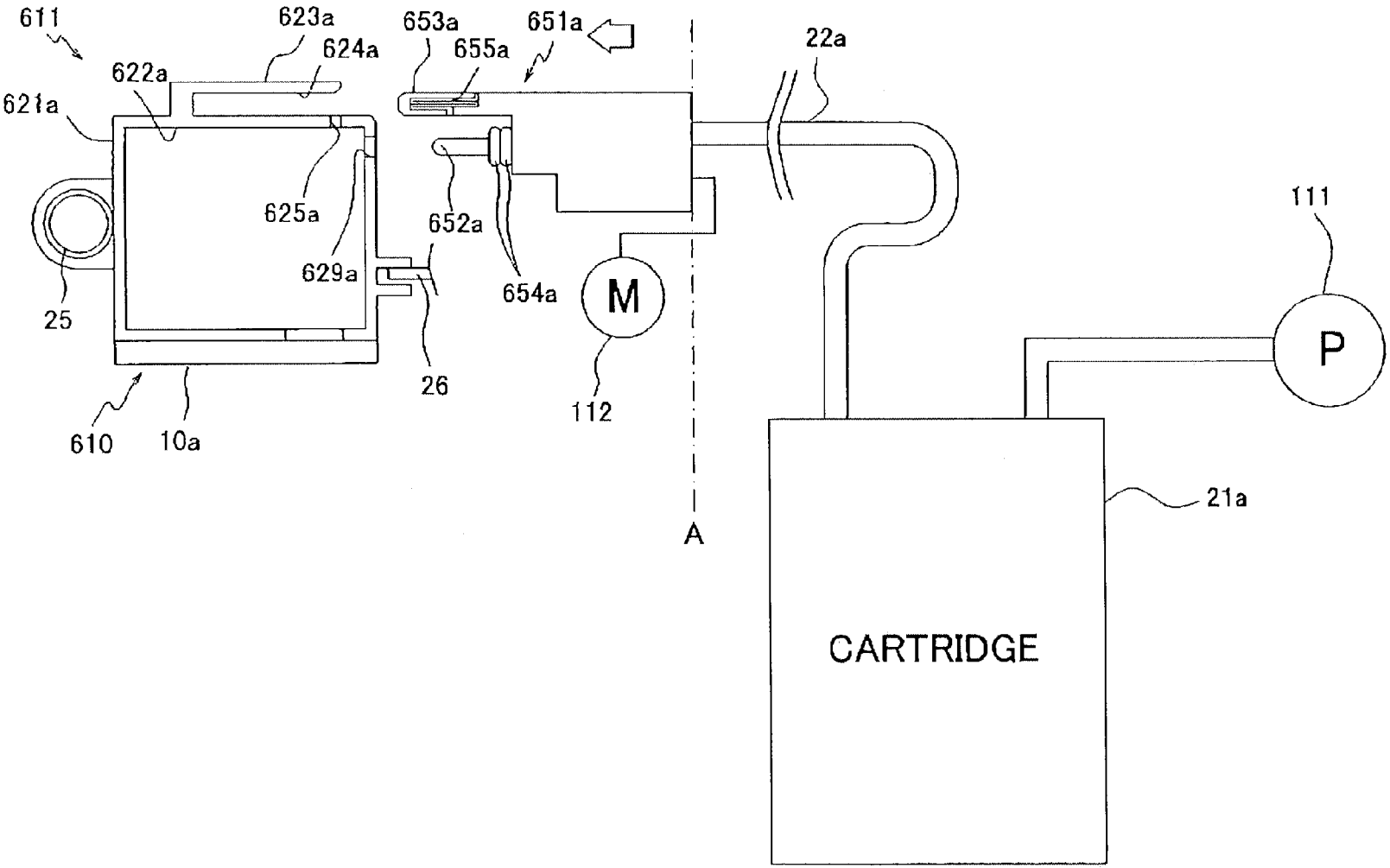
FIG. 14 is an explanatory view showing a schematic structure of a recording head and an ink supply mechanism according to a sixth embodiment.
Figure 17A:
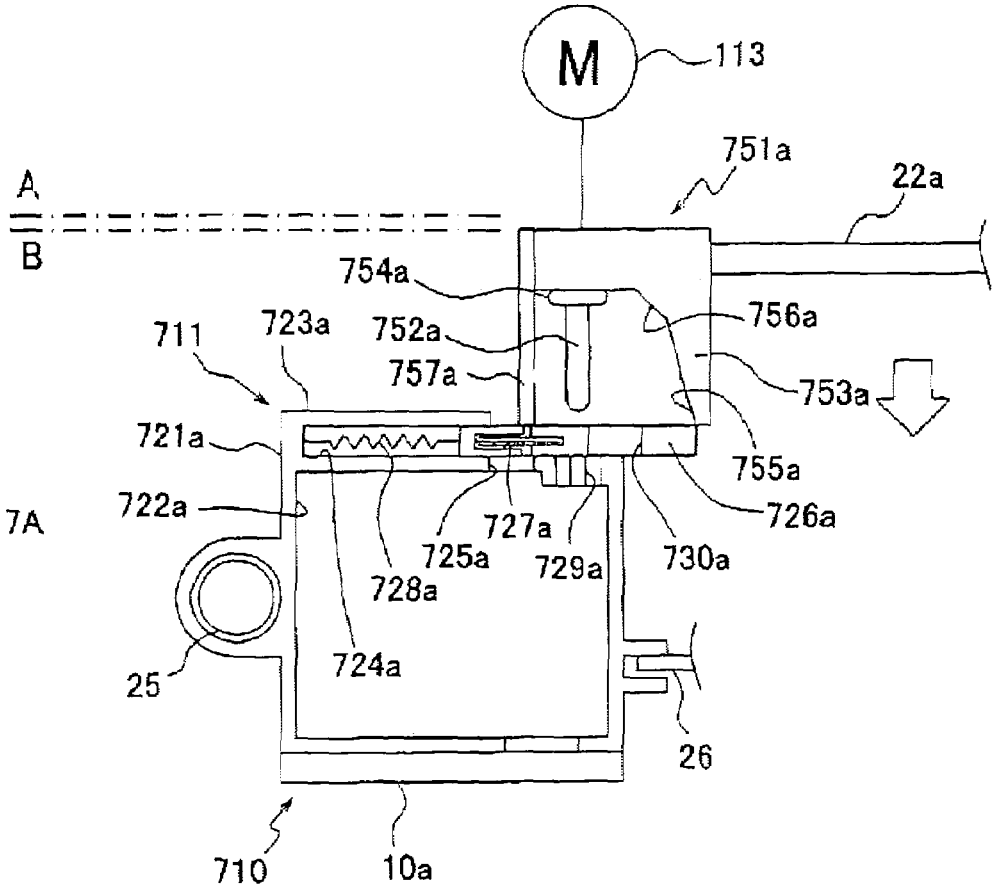
FIG. 17A is an explanatory view showing the recording head and the ink supply mechanism according to the seventh embodiment during long-term storage.
Figure 17B:
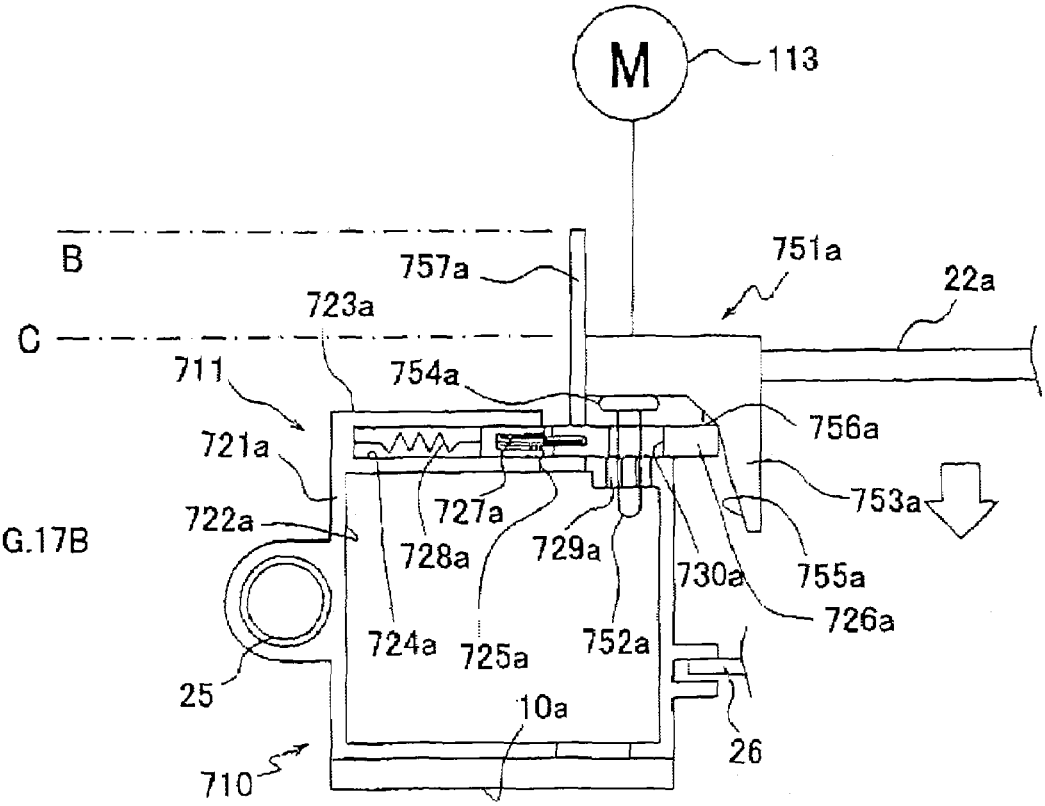
FIG. 17B is an explanatory view showing the recording head and the ink supply mechanism according to the seventh embodiment during ink supply and during standby.
Figures 18A, 18B:
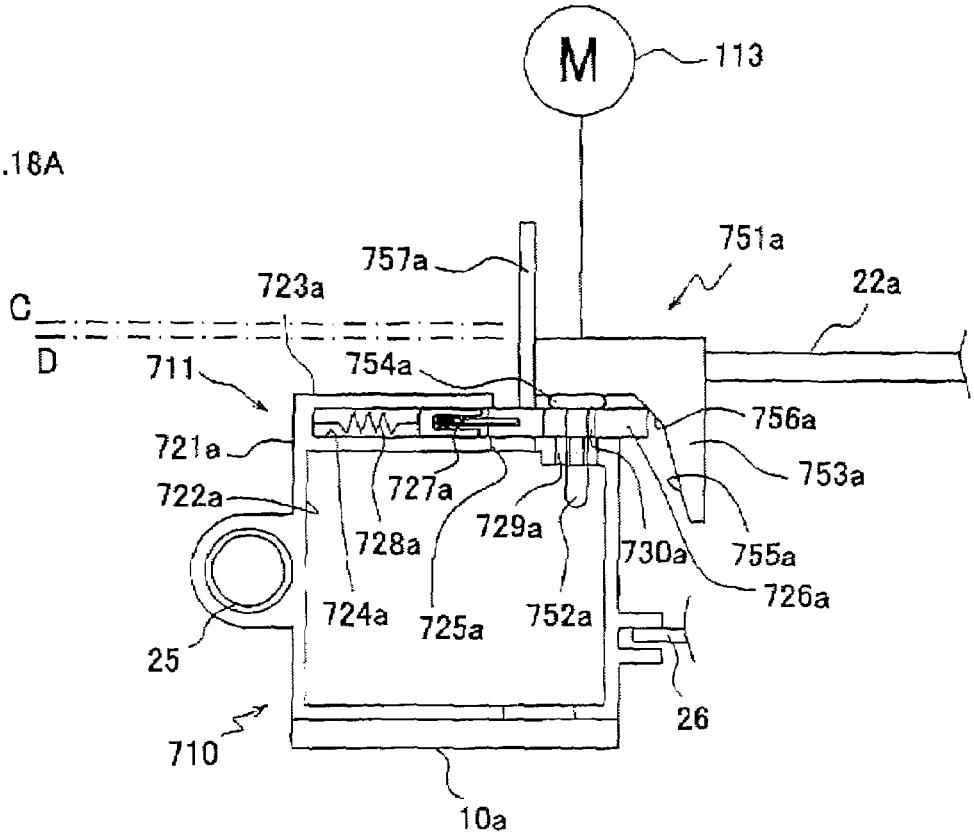
FIG. 18A is an explanatory view showing the recording head and the ink supply mechanism according to the seventh embodiment during positive pressure purge.
FIG. 18B is a table showing an open/close state of the air communication hole and the ink supply opening according to the seventh embodiment.

As shown in FIG. 14, a recording head 610 has internal sub-tanks 621*a* to 621*d* (only internal sub-tank 621*a* is shown in FIG. 14), each of which stores one of four colors of ink. The sub-tanks 621*a* to 621*d* are the same in structure. Therefore, in the following description, only the structure of the sub-tank 621*a* for one specific color of ink will be explained in detail. Descriptions of the sub-tanks 621*b* to 621*d* for the other colors of ink are arbitrarily omitted. The same applies to ink supply mechanisms 651*a* to 651*d*. The sub-tank 621*a* is provided with a tank body 622*a* for storing ink, and an exhaust portion 623*a* for discharging the air inside the tank body 622*a* to the outside. The exhaust portion 623*a* includes a cavity portion 624*a*, and an air communication hole 625*a*. The cavity portion 624*a* is formed on the top of the recording head 610 and opens frontward. The air communication hole 625*a* communicates the tank body 622*a* with the atmosphere via the cavity portion 624*a*.

The cavity portion 624*a* is arranged to face a switching member 653*a* of the later-explained ink supply mechanism 651*a*. The cavity portion 624*a* is communicated with the tank body 622*a* via the air communication hole 625*a*. Accordingly, the tank body 622*a* is communicated with the atmosphere via the cavity portion 624*a* and the air communication hole 625*a*.

The tank body 622*a* is provided with an ink supply opening 629*a* for receiving an ink supply from an ink supply nozzle 652*a*. The ink supply opening 629*a* is disposed to face the ink supply nozzle 652*a* of the ink supply mechanism 651*a*. The ink supply opening 629*a* can be attached to/detached from the ink supply nozzle 652*a* by the movement of the ink supply mechanism 651*a*. The ink supply opening 629*a* includes an internal valve (not shown) that can seal the ink supply opening 629*a* when the ink supply nozzle 652*a* is separated from the ink supply opening 629*a*.

[Description of Ink Supply Mechanism 651*a*]

As shown in FIG. 14, the ink supply mechanism 651*a* includes an ink supply nozzle 652*a* for supplying ink to the tank body 622*a* of the sub-tank 621*a*, and the switching member 653*a* for switching the communication state of the air communication hole 625*a* of the exhaust portion 623*a* is provided in the recording head 610. The ink supply mechanism 651*a* is disposed ahead of the carriage 611 (recording head 610) when the carriage 611 is located above the wiper or caps of the maintenance mechanism (given position). Also, the ink supply mechanism 651*a* can be moved to the front and rear by the driving force of the ink supply mechanism driving motor 112, which is controlled by the control processor 70. The ink supply nozzle 652*a* is arranged to face the ink supply opening 629*a* of the sub-tank 621*a*. The ink supply nozzle 652*a* can be attached to/detached from the ink supply opening 629*a* of the sub-tank 621*a* by the movement of the ink supply mechanism 651*a*. Two packings 654*a*, such as O-rings for sealing, are attached to the ink supply nozzle 652*a*. The switching member 653*a* is arranged to face the cavity portion 624*a* of the exhaust portion 623*a* provided in the recording head 610. The switching member 653*a* can be moved into the cavity portion 624*a* by the movement of the carriage 611. The switching member 653*a* has a switching member communication hole 655*a*. The switching member communication hole 655*a* is formed as a labyrinth and is constituted as follows. That is, when the switching member 653*a* is separated from the cavity portion 624*a* by the movement of the ink supply mechanism 651*a*, the switching member communication hole 655*a* allows the air communication hole 625*a* to be communicated with the atmosphere (communication position, see FIG. 14). When the switching member 653*a* is inserted into the cavity portion 624*a* by the movement of the ink supply mechanism 651*a*, the switching member communication hole 655*a* allows the air communication hole 625*a* to be communicated with the atmosphere (communication position, see FIG. 15A). When the switching member 653*a* is inserted further into the cavity portion 624*a* by the movement of the carriage 611, the switching member communication hole 655*a* disallows the air communication hole to be communicated with the atmosphere (non-communication position, see FIG. 15B).

The positional relationship between the air communication hole 625*a* and the ink supply opening 629*a* provided in the recording head 610, and the switching member 653*a* and the ink supply nozzle 652*a* provided in the ink supply mechanism 651*a*, is set as follows. That is, the recording head 610 and the ink supply mechanism 651*a* can be brought into the following states (6-1) to (6-3) by moving the ink supply mechanism 651*a* to the front and rear by the driving force of the ink supply mechanism driving motor 112.

(6-1) The switching member 653*a* is separated from the cavity portion 624*a*. The air communication hole 625*a* and the atmosphere are communicated. The ink supply nozzle 652*a* of the ink supply mechanism 651*a* is not connected to the ink supply opening 629*a* of the recording head 610 (communication position, see FIG. 14).

(6-2) The switching member 653*a* is inserted into the cavity portion 624*a*. The air communication hole 625*a* and the atmosphere are communicated via the switching member communication hole 655*a* of the switching member 653*a*. The ink supply nozzle 652*a* of the ink supply mechanism 651*a* is connected to the ink supply opening 629*a* of the recording head 610 so that ink can be supplied from the ink cartridge 21*a* to the sub-tank 621*a* (communication position, see FIG. 15A).

(6-3) The switching member 653*a* is inserted further into the cavity portion 624*a*. The air communication hole 625*a* is no longer communicated with the atmosphere. The ink supply nozzle 652*a* of the ink supply mechanism 651*a* is connected to the ink supply opening 629*a* of the recording head 610 so that ink can be supplied from the ink cartridge 21*a* to the sub-tank 621*a* (non-communication position, see FIG. 15B).

[Description of Control Processor 70]

The control processor 70 moves the ink supply mechanisms 651*a* to 651*d* to the front and rear by controlling the ink supply mechanism driving motor 112 via a driving circuit (not shown). The control processor 70 can bring the recording head 610 and the ink supply mechanisms 651*a* to 651*d* into the aforementioned states (6-1) to (6-3) by changing the relative position between the recording head 610 and the ink supply mechanisms 651*a* to 651*d*.

[Description of Operation of Ink Supply Mechanism 651*a*]

In the sixth embodiment as described above, the control processor 70 operates the ink supply mechanism 651*a* as follows.

During standby when the carriage 611 (recording head 610) is located above the wiper and caps of the maintenance mechanism (given position), the ink supply mechanism driving motor 112 is driven to move the ink supply mechanism 651*a* rearward. The ink supply nozzle 652*a* is connected to the ink supply opening 629*a*. The switching member 653*a* is inserted into the cavity portion 624*a*, such that the air connection hole 625*a* is communicated with the atmosphere via the switching member communication hole 655*a* of the switching member 653*a* (ink supply position, see FIG. 15A, in FIGS. 15A to 15C, the end position of the ink supply mechanism 651*a* in the ink supply position is indicated by the reference symbol "B"). In this case, ink can be supplied from the ink cartridge 21*a* to the sub-tank 621*a* of the recording head 610 by driving the pressurized pump 111 (see FIG. 14) (standby mode and ink supply mode, see FIGS. 15A and 15C).

Now, in order to perform image recording onto a sheet, the ink supply mechanism motor 112 is driven to move the ink supply mechanism 651*a* frontward. The ink supply nozzle 652*a* is separated from the ink supply opening 629*a*. The switching member 653*a* is also separated from the cavity portion 624*a* (recording position, see FIG. 14, in FIG. 14, the end position of the ink supply mechanism 651*a* in the recording position is indicated by the reference symbol "A"). In this case, the ink supply opening 629*a* is sealed with an internal valve, while the air communication hole 625*a* continues to be communicated with the atmosphere (recording (printing) mode, see FIGS. 14 and 15C). The carriage 611 is moved leftward by driving the carriage motor 30, and the aforementioned sheet end detection process and recording process are executed.

On the other hand, in order to recover the ink discharge performance of the recording head 610, the ink supply mechanism driving motor 112, when the carriage 611 (recording head 610) is above the wiper and the caps of the maintenance mechanism (given position), is driven to move the ink supply mechanism 651*a* further rearward. The ink supply nozzle 652*a* is connected to the ink supply opening 629*a*. The switching member 653*a* is inserted into further into the cavity portion 624*a*, such that the air communication hole 625*a* is no longer communicated with the atmosphere (discharge performance recovery position, see FIG. 15B) in FIGS. 15A to 15C, the end position of the ink supply mechanism 651*a* at the discharge performance recovery position is indicated by the reference symbol "C"). Even after the ink supply nozzle 652*a* is connected to the ink supply opening 629*a*, the ink supply mechanism 651*a* can be moved further rearward due to the elasticity of packings 654*a*. In this case, ink can be supplied from the ink cartridge 21*a* to the sub-tank 621*a* of the recording head 610 by driving the pressurized pump 111 (see FIG. 14) (during discharge performance recovery (positive pressure purge), see FIGS. 15B and 15C). The ink discharge performance by the ink nozzle group 10*a* of the recording head 610 can be recovered by discharging ink from the ink nozzle group 10*a*.

[Effects]

According to the sixth embodiment, the same effects as those described in the fifth embodiment can be achieved.

Seventh Embodiment

In the sixth embodiment, the control processor 70 moves the ink supply mechanism 651*a*, disposed ahead of the carriage 611 (recording head 610) when the carriage 611 is located above the wiper and caps of the maintenance mechanism (given position), to the front and rear by controlling the ink supply mechanism driving motor 112, and changes the relative position between the sub-tank 621*a* of the recording head 610 and the ink supply mechanism 651*a*. In the seventh embodiment shown in FIGS. 16, 17A, 17B, 18A and 18B, the control processor 70 is designed to move a ink supply mechanism 751*a*, disposed above a carriage 711 (recording head 710) when the carriage 711 is located above the wiper and caps of the maintenance mechanism (given position), in a vertical direction by controlling an ink supply mechanism driving motor 113, and changes the relative position between a sub-tank 721*a* of the recording head 710 and an ink supply mechanism 751*a*.

Hereinafter, the structure of the multifunctional apparatus according to the seventh embodiment is described by way of FIGS. 16, 17A, 17B, 18A and 18B. Many of the components are common in both of the sixth and seventh embodiments. Therefore, the same reference numbers are given to identical components, and descriptions thereof are not repeated.

[Description of Recording Head 710]

As shown in FIG. 16, a recording head 710 has internal sub-tanks 721*a* to 721*d* (only internal sub-tank 721*a* is shown in FIG. 16), each of which stores one of four colors of ink. The sub-tanks 721*a* to 721*d* are the same in structure. Therefore, in the following description, only the structure of the sub-tank 721*a* for one specific color of ink will be explained in detail. Descriptions of the sub-tanks 721*b* to 721*d* for the other colors of ink are arbitrarily omitted. The same applies to ink supply mechanisms 751*a* to 751*d*. The sub-tank 721*a* is provided with a tank body 722*a* for storing ink, and an exhaust portion 723*a* for discharging the air inside the tank body 722*a* to the outside. The exhaust portion 723*a* includes a cavity portion 724*a*, an air communication hole 725*a*, a slider 726*a*, and a spring device 728*a*. The cavity portion 724*a* is formed on top of the recording head 710 and opens frontward. The air communication hole 725*a* is a long hole that communicates the tank body 722*a* with the atmosphere via the cavity portion 724*a*. At least a part of the slider 726*a* is disposed inside the cavity portion 724*a*. The slider 726*a* opens/closes the air communication hole 725*a*.

The tank body 722*a* is provided with an ink supply opening 729*a* for receiving ink supply from an ink supply nozzle 752*a*. The ink supply opening 729*a* is disposed to face the ink supply nozzle 752*a* of the ink supply mechanism 751*a*. The ink supply opening 729*a* can be attached to/detached from the ink supply nozzle 752*a* by the movement of the ink supply mechanism 751*a*. The ink supply opening 729*a* includes an internal valve (not shown) that can seal the ink supply opening 729*a* when the ink supply nozzle 752*a* is separated from the ink supply opening 729*a*.

The cavity portion 724*a* is arranged to face a switching member 753*a* of the later-explained ink supply mechanism 751*a*. The cavity portion 724*a* is communicated with the tank body 722*a* via the air communication hole 725*a*. Accordingly, the tank body 722*a* is communicated with the atmosphere via the cavity portion 724*a* and the air communication hole 725*a*.

The slider 726*a* can be moved to the front and rear inside the cavity portion 724*a*. The slider 726*a* is pressed frontward by the spring device 728*a* that is also disposed inside the cavity portion 724*a*. The slider 726*a* has a communication hole 727*a*. The communication hole 727*a* is formed as a labyrinth and is constituted as follows. That is, when the slider 726*a* is moved frontward by a biasing force of the spring device 728*a*, the communication hole 727*a* allows the air communication hole 725*a* to be communicated with the atmosphere (communication position, see FIG. 16). When the slider 726*a* is pressed with the switching member 753*a* by the movement of the ink supply mechanism 751*a* and moved rearward against the biasing force of the spring device 728*a*, the communication hole 727*a* disallows the air communication hole 725*a* to be communicated with the atmosphere (non-communication position, see FIG. 18A).

Also, the slider 726*a* has a long through hole 730*a* at a front portion. The through hole 730*a* is constituted as follows. That is, when the slider 726*a* is moved frontward by the biasing force of the spring device 728*a*, the through hole 730*a* is not communicated with the ink supply opening 729*a* (see FIG. 16). When the slider 726*a* is pressed by the switching member 753*a* through the movement of the later-explained ink supply mechanism 751*a* and moved rearward against the biasing force of the spring device 728*a*, the through hole 730*a* is communicated with the ink supply opening 729*a* (see FIGS. 17B and 18A).

[Description of Ink Supply Mechanism 751*a*]

As shown in FIG. 16, the ink supply mechanism 751*a* includes an ink supply nozzle 752*a* for supplying ink to the tank body 722*a* of the sub-tank 721*a*, and a switching member 753*a* for pressing the slider 726*a* of the exhaust portion 723*a* provided in the recording head 710. The ink supply mechanism 751*a* is disposed above the carriage 711 (recording head 710) when the carriage 711 is located above the wiper or caps of the maintenance mechanism (given position). Also, the ink supply mechanism 751*a* can be moved in the vertical direction by the driving force of the ink supply mechanism driving motor 113, which is controlled by the control processor 70. The ink supply nozzle 752*a* is arranged to face the ink supply opening 729*a* of the sub-tank 721*a*. The ink supply nozzle 752*a* can be attached to/detached from the ink supply opening 729*a* of the sub-tank 721*a* by the movement of the ink supply mechanism 751*a*. Two packings 754*a*, such as O-rings for sealing, are attached to the ink supply nozzle 752*a*. The switching member 753*a* is arranged to face the slider 726*a* of the exhaust portion 723*a* provided in the recording head 710. The switching member 753*a* can be attached to/detached from the slider 726*a* by the movement of the ink supply mechanism 751*a*. The switching member 753*a* is provided with two cam faces 755*a*, 756*a* having different slant angles with respect to the moving direction of the slider 726*a*. These cam faces are formed into a shape such that the distance moved by the slider 726*a* when the switching member 753*a* is moved in the vertical direction together with the movement of the ink supply mechanism 751*a* and abutted on the slider 726*a*, differs depending upon the moved position of the ink supply mechanism 751*a*. In the present embodiment, the switching member 753*a* is provided with two cam faces 755*a*, 756*a*. However, the switching member 753*a* may be provided with only one cam face or three or more cam faces.

The ink supply mechanism 751*a* also includes a closing member 757*a* for closing the communication hole 727*a* of the slider 726*a* for a long-term storage. The closing member 757*a* is provided with the ink supply mechanism 751*a* in a manner movable in the vertical direction. The closing member 757*a* is biased to look downward by a spring device (not shown).

The positional relationship between the air communication hole 725*a* and the ink supply opening 729*a* provided in the recording head 710, and the switching member 753*a* and the ink supply nozzle 752*a* provided in the ink supply mechanism 751*a*, is set as follows. That is, the recording head 710 and the ink supply mechanism 751*a* can be brought into the following states (7-1) to (7-4) by moving the ink supply mechanism 751*a* in the vertical direction through the driving force of the ink supply mechanism driving motor 113, when the carriage 711 (recording head 710) is located above the wiper and caps of the maintenance mechanism (given position).

(7-1) The slider 726*a* of the recording head 710 and the switching member 753*a* of the ink supply mechanism 751*a* are separated. The tank body 722*a* of the sub-tank 721*a* is communicated with the atmosphere via the air communication hole 725*a* and the communication hole 727*a*. The ink supply nozzle 752*a* of the ink supply mechanism 751*a* is not connected to the ink supply opening 729*a* of the recording head 710 (communication position, see FIG. 16).

(7-2) The slider 726*a* of the recording head 710 and the switching member 753*a* of the ink supply mechanism 751*a* are separated. The tank body 722*a* of the sub-tank 721*a* would otherwise be communicated with the atmosphere via the air communication hole 725*a* and the communication hole 727*a*. While the ink supply nozzle 752*a* of the ink supply mechanism 751*a* is not connected to the ink supply opening 729*a* of the recording head 710, the closing member 757*a* is abutted on the slider 726*a* so as to close the communication hole 727*a* (non-communication position, see FIG. 17A).

(7-3) The slider 726*a* of the recording head 710 is pressed by the switching member 753*a* (cam face 755*a*) of the ink supply mechanism 751*a* and is moved rearward. The tank body 722*a* of the sub-tank 721*a* is communicated with the atmosphere via the air communication hole 725*a* and the communication hole 727*a*. The ink supply nozzle 752*a* of the ink supply mechanism 751*a* is connected to the ink supply opening 729*a* that is communicated with the through hole 730*a* of the slider 726*a* so that ink can be supplied from the ink cartridge 21*a* to the sub-tank 721*a* (communication position, see FIG. 17B).

(7-4) The slider 726*a* of the recording head 710 is pressed by the switching member 753*a* (cam face 756*a*) of the ink supply mechanism 751*a* and is moved further rearward. The tank body 722*a* of the sub-tank 721*a* is no longer communicated with the atmosphere. The ink supply nozzle 752*a* of the ink supply mechanism 751*a* is connected to the ink supply opening 729*a* of the recording head 710 so that ink can be supplied from the ink cartridge 21*a* to the sub-tank 721*a* (communication position, see FIG. 18A).

[Description of Control Processor 70]

The control processor 70 moves the ink supply mechanisms 751*a* to 751*d* in the vertical direction by controlling the ink supply mechanism driving motor 113 via a driving circuit (not shown). The control processor 70 can bring the recording head 710 and the ink supply mechanisms 751*a* to 751*d* into the aforementioned states (7-1) to (7-4) by changing the relative position between the recording head 710 and the ink supply mechanisms 751*a* to 751*d*.

[Description of Operation of Ink Supply Mechanism 751*a*]

In the seventh embodiment as described above, the control processor 70 operates the ink supply mechanism 751*a* as follows.

During standby when the carriage 711 (recording head 710) is located above the wiper and caps of the maintenance mechanism (given position), the ink supply mechanism driving motor 113 is driven to move the ink supply mechanism 751*a* downward. The ink supply nozzle 752*a* is connected to the ink supply opening 729*a*, which is communicated with the through hole 730*a* of the slider 726*a*. The switching member 753*a* (cam face 755*a*) moves the slider 726*a* rearward against the biasing force of the spring device 728*a*, such that the air connection hole 725*a* is communicated with the atmosphere (ink supply position, see FIG. 17B, in FIGS. 17A and 17B, the end position of the ink supply mechanism 751*a* in the ink supply position is indicated by the reference symbol "C"). Even after the closing member 757*a* is abutted on the slider 726*a*, the ink supply mechanism 751*a* can be moved further downward due to the operation of a not shown spring device. In this case, ink can be supplied from the ink cartridge 21*a* to the sub-tank 721*a* of the recording head 710 by driving the pressurized pump 111 (see FIG. 16) (standby mode and ink supply mode, see FIGS. 17B and 18B).

Here, in order to store the ink inside the sub-tank 721*a* for a long period of time, the ink supply mechanism driving motor 113 is driven to move the ink supply mechanism 751*a* upward. The ink supply nozzle 752*a* is separated from the ink supply opening 729*a*. While the switching member 753*a* is also separated from the slider 726*a*, the closing member 757*a* is abutted on the slider 726*a* such that the communication hole 727*a* is closed (long-term storage position, see FIG. 17A, long-term storage mode, in FIGS. 17A and 17B, the end position of the ink supply mechanism 751*a* in the long-term storage position is indicated by the reference symbol "B").

Now, in order to perform image recording onto a sheet, the ink supply mechanism motor 113 is driven to move the ink supply mechanism 751*a* upward. The ink supply nozzle 752*a* is separated from the ink supply opening 729*a*. The switching member 753*a* is also separated from the slider 726*a* (recording position, see FIG. 16, in FIG. 16, the end position of the ink supply mechanism 751*a* in the recording position is indicated by the reference symbol "A"). In this case, the ink supply opening 729*a* is sealed with an internal valve and the slider 726*a* also closes the top portion of the ink supply opening 729*a*, while the air communication hole 725*a* continues to be communicated with the atmosphere (recording (printing) mode, see FIGS. 16 and 18B). The carriage 711 is moved leftward by driving the carriage motor 30, and the aforementioned sheet end detection process and recording process are executed.

On the other hand, in order to recover the ink discharge performance of the recording head 710, the ink supply mechanism driving motor 113, when the carriage 711 (recording head 710) is above the wiper and the caps of the maintenance mechanism (given position), is driven to move the ink supply mechanism 751*a* further downward. The ink supply nozzle 752*a* is connected to the ink supply opening 729*a*. The switching member 753*a* (cam face 756*a*) moves the slider 726*a* rearward against the biasing force of the spring device 728*a*, such that the communication hole 727*a* of the slider 726*a* and the air communication hole 725*a* are no longer communicated (discharge performance recovery position, see FIG. 18A, in FIGS. 18A and 18B, the end position of the ink supply mechanism 751*a* at the discharge performance recovery position is indicated by the reference symbol "D"). Even after the ink supply nozzle 752*a* is connected to the ink supply opening 729*a*, the ink supply mechanism 751*a* can be moved further rearward due to the elasticity of packings 754*a*. In this case, ink can be supplied from the ink cartridge 21*a* to the sub-tank 721*a* of the recording head 710 by driving the pressurized pump 111 (see FIG. 16) (during discharge performance recovery (positive pressure purge), see FIGS. 18A and 18B). The ink discharge performance by the ink nozzle group 10*a* of the recording head 710 can be recovered by discharging ink from the ink nozzle group 10*a*.

[Effects]

According to the seventh embodiment, the sub-tank 721*a* can be sealed by closing the air communication hole 725*a* with the slider 726*a* being moved by the cam faces 755*a*, 756*a* of the switching member 753*a*. Therefore, in addition to achieving the effects in the sixth embodiment, the seventh embodiment can also cope with long-term storage, such as shipping, of the multifunctional apparatus.

Other Embodiments

Embodiments of the present invention are described in the above. However, the present invention is not limited to the above described embodiments. The present invention can be practiced in various manners without departing from the technical scope of the invention.

For example, in the first embodiment, ink is supplied to the sub-tank 101*a* of the recording head 10 from the ink cartridge 21*a* by driving the pressurized pump 111. However, ink can be supplied to the sub-tank 101*a* of the recording head 10 from the ink cartridge 21*a* in other manners, e.g., by a pressurized device other than pumps.

What is claimed is:

1. An ink-jet recording apparatus comprising:

a recording head that has an internal sub-tank for storing ink, and records an image on a recording medium by ejecting ink inside the sub-tank from an injection nozzle;

a carriage that has the recording head mounted thereon, and can move to and fro in a direction orthogonal to a conveying direction of the recording medium;

a main tank that stores ink supplied to the sub-tank;

an ink supply member that supplies ink inside the main tank to the sub-tank;

a relative position changer that can change a relative position between the ink supply member and the sub-tank;

the sub-tank including an ink supply opening that can be attached to/detached from the ink supply member and through which the ink inside the main tank is supplied, and an air communication hole that communicates an inside of the sub-tank with the atmosphere, the ink supply member including an ink supply nozzle that can be attached to/detached from the ink supply opening, and an open/close state switching member that switches an open/close state of the air communication hole, a pressurized unit that applies pressure to the ink inside the main tank so as to deliver the ink inside the main tank to the ink supply member, and a relative position controller that controls the relative position changer to switch an operation mode of the ink-jet recording apparatus to at least following three modes: (a) a recording mode in which the ink supply opening and the ink supply nozzle are separated and the air communication hole is in an open state so that recording of an image on the recording medium is enabled; (b) an ink supply mode in which the ink supply opening is connected to the ink supply nozzle and the air communication hole is in an open state so that ink is supplied to the sub-tank by pressure applied by the pressurized unit; and (c) a discharge performance recovery mode in which the ink supply opening and the ink supply nozzle are closely connected and the air communication hole is in a closed state so that discharge performance of the recording head is recovered by the pressure applied by the pressurized unit.

2. The ink-jet recording apparatus according to claim 1, wherein the carriage can move to at least following three positions: (i) a recording position where image recording onto the recording medium is enabled; (ii) an ink supply position where ink is supplied to the sub-tank by the pressure applied by the pressurized unit; and (iii) a discharge performance recovery position where the discharge performance of the recording head is recovered, by to-and-fro motion of the carriage in the direction orthogonal to the conveying direction of the recording medium, the relative position changer can change the relative position between the ink supply member and the sub-tank by moving the carriage to and fro in the direction orthogonal to the conveying direction of the recording medium, the ink supply member, when the carriage is moved by the relative position changer to the recording position, brings the ink supply opening and the ink supply nozzle into a separated state and brings the air communication hole into an open state, when the carriage is moved by the relative position changer to the ink supply position, brings the ink supply opening and the ink supply nozzle into a connected state and brings the air communication hole into an open state, and when the carriage is moved by the relative position changer to the discharge performance recovery position, brings the ink supply opening and the ink supply nozzle into a closely connected state and brings the air communication hole into a closed state, the relative position controller controls the relative position changer to move the carriage to (i) the recording position when the recording mode is selected, (ii) the ink supply position when the ink supply mode is selected, and (iii) the discharge performance recovery position when the discharge performance recovery mode is selected.

3. The ink-jet recording apparatus according to claim 1, wherein the ink supply member can move to at least following three positions: (i) a recording position where the ink supply opening and the ink supply nozzle are brought into a separated state and the air communication hole is brought into an open state so that image recording onto the recording medium is enabled; (ii) an ink supply position where the ink supply opening and the ink supply nozzle are brought into a connected state and the air communication hole is brought into an open state so that ink is supplied to the sub-tank by the pressure applied by the pressurized unit; and (iii) a discharge performance recovery position where the ink supply opening and the ink supply nozzle are brought into a closely connected state and the air communication hole is brought into a closed state so that the discharge performance of the recording head is recovered, by being moved with respect to the carriage at a given position, the relative position changer can change the relative position between the ink supply member and the sub-tank by moving the ink supply member with respect to the carriage at a given position, the relative position controller controls the relative position changer to move the ink supply member to (i) the recording position when the recording mode is selected, (ii) the ink supply position when the ink supply mode is selected, and (iii) the discharge performance recovery position when the discharge performance recovery mode is selected.

4. The ink-jet recording apparatus according to claim 1, wherein the sub-tank includes:

an air communication hole open/close member that can be moved between a communication position where the air communication hole is communicated with the atmosphere and a non-communication position where the air communication hole is not communicated with the atmosphere; and a biasing device that biases the air communication hole open/close member to the communication position, the open/close state switching member of the ink supply member is designed to separate from or abut on the air communication hole open/close member, by the relative position changer changing the relative position between the ink supply member and the sub-tank, so as to move the air communication hole open/close member between the communication position and the non-communication position.

5. The ink-jet recording apparatus according to claim 4, wherein the open/close state switching member of the ink supply member has a cam face that is formed into a shape such that a distance moved by the air communication hole open/close member when abutted by the open/close state switching member differs depending on a moved position of the ink supply member.

6. The ink-jet recording apparatus according to claim 1, wherein the open/close switching member of the ink supply member includes a switching member communication hole that communicates the air communication hole with the atmosphere, and is designed capable of being moved between a communication position where the air communication hole and the switching member communication hole are communicated so that the air communication hole is communicated with the atmosphere, and a non-communication position where the air communication hole and the switching member communication hole are not communicated so that the air communication hole is not communicated with the atmosphere, in accordance with a relative position between the sub-tank and the open/close state switching member.

7. The ink-jet recording apparatus according to claim 1, wherein a valve is provided which seals the ink supply opening when the ink supply opening and the ink supply nozzle are in a separated state.

8. The ink-jet recording apparatus according to claim 7, wherein the relative position controller can switch the operation mode of the ink-jet recording apparatus to a long-term storage mode in which the ink inside the sub-tank is stored for a long period of time, by controlling the relative position changer to bring the ink supply opening and the ink supply nozzle into a separated state and to bring the air communication hole into a closed state.

* * * * *